US008152287B2

(12) United States Patent
Hattori et al.

(10) Patent No.: US 8,152,287 B2
(45) Date of Patent: Apr. 10, 2012

(54) INK CARTRIDGE ASSEMBLIES

(75) Inventors: Shingo Hattori, Nagoya (JP); Toyonori Sasaki, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 942 days.

(21) Appl. No.: 12/021,137

(22) Filed: Jan. 28, 2008

(65) Prior Publication Data

US 2009/0058964 A1 Mar. 5, 2009

(30) Foreign Application Priority Data

Aug. 31, 2007 (JP) ..... 2007227122
Dec. 27, 2007 (JP) ..... 2007336604

(51) Int. Cl.
*B41J 2/175* (2006.01)

(52) U.S. Cl. ..... 347/86; 347/84

(58) Field of Classification Search ..... None
See application file for complete search history.

(56) References Cited

U.S. PATENT DOCUMENTS

| | | | | |
|---|---|---|---|---|
| 6,097,407 | A | 8/2000 | Terasawa et al. | |
| 6,102,535 | A * | 8/2000 | Papenfuhs et al. | 347/86 |
| 6,113,230 | A | 9/2000 | Ishinaga et al. | |
| 6,623,104 | B1 | 9/2003 | Kotaki et al. | |
| 7,237,885 | B1 * | 7/2007 | Sasaki et al. | 347/86 |
| 7,819,512 | B2 * | 10/2010 | Hattori | 347/86 |
| 2001/0038407 | A1 | 11/2001 | Umemura et al. | |
| 2004/0196340 | A1 * | 10/2004 | Inoue et al. | 347/86 |
| 2006/0033066 | A1 * | 2/2006 | Carrez et al. | 251/297 |
| 2006/0066694 | A1 * | 3/2006 | Uwagaki et al. | 347/84 |
| 2006/0203051 | A1 | 9/2006 | Kanbe | |
| 2007/0064080 | A1 | 3/2007 | Usui | |

FOREIGN PATENT DOCUMENTS

| | | | |
|---|---|---|---|
| EP | 0439728 | A2 | 8/1991 |
| EP | 0559206 | A2 | 9/1993 |
| JP | 6191046 | A | 7/1994 |
| JP | 2007055218 | A | 3/2007 |

OTHER PUBLICATIONS

European Patent Office, European Search Report for European Patent Application No. EP08003714 (counterpart to above-captioned patent application), dated Jul. 3, 2008.

* cited by examiner

*Primary Examiner* — Matthew Luu
*Assistant Examiner* — Erica Lin
(74) *Attorney, Agent, or Firm* — Baker Botts L..L.P.

(57) ABSTRACT

An ink cartridge assembly includes an ink cartridge including a body defining an ink chamber therein, and a sealing member. The body has an opening formed therethrough, and an interior of the ink chamber is configured to be in fluid communication with an exterior of the ink chamber via the opening. The sealing member is configured to close the opening. The ink cartridge assembly also includes a cover member including a first portion configured to engage the body, and a second portion. The cover member is configured to cover the opening when the first portion engages the body. When the second portion moves the second portion is configured to apply a force to the sealing member to move the sealing member away from the opening to facilitate fluid communication between the interior and the exterior of the ink chamber, and to disengage the first portion from the body.

14 Claims, 25 Drawing Sheets

INK CARTRIDGE ASSEMBLIES

CROSS-REFERENCE TO RELATED APPLICATION

The present application claims priority from Japanese Patent Application No. JP-2007-227122, which was filed on Aug. 31, 2007, and Japanese Patent Application No. JP-2007-336604, which was filed on Dec. 27, 2007, the disclosures of which are incorporated herein by reference in their entirety.

BACKGROUND OF THE INVENTION

1. Field of the Invention

The present invention relates generally to ink cartridge assemblies, and more specifically, to ink cartridge assemblies comprising an ink cartridge configured to store ink therein, and a cover member which covers an opening, such that when the cover member is removed, the cover member moves a sealing member away from the opening, which allows fluid communication between an interior and an exterior of the ink cartridge.

2. Description of Related Art

A known ink cartridge is configured to be selectively mounted to and removed from a known recording apparatus, e.g., a known inkjet recording apparatus. The ink cartridge includes an ink chamber configured to store ink, and an ink supply portion configured to supply ink from the interior of the ink chamber to the exterior of the ink chamber. When the ink cartridge is mounted to a cartridge storage section of the recording apparatus, a needle of the cartridge storage section is inserted into the ink supply portion, such that ink is supplied from the ink chamber to the recording apparatus.

The pressure in the ink chamber is less than the atmospheric pressure before the ink cartridge is mounted to the recording apparatus. Therefore, when the ink cartridge is mounted to the recording apparatus, ink may flow back to the ink chamber from the recording apparatus, and menisci of ink in nozzles of a recording head may be damaged. To prevent the backflow of ink, the ink cartridge has an opening formed therethrough. The opening is closed by a sticker before the ink cartridge is mounted to the recording apparatus. Before a user mounts the ink cartridge to the recording apparatus, the user removes the sticker, which equalizes the pressure inside the ink chamber and the atmospheric pressure via the opening. Nevertheless, if the user fails to remove the sticker before mounting the ink cartridge to the recording apparatus, the pressure inside the ink chamber will be less than the atmospheric pressure when the ink cartridge is mounted to the recording apparatus, and ink may flow back to the ink chamber from the recording apparatus.

Another known recording apparatus has a mechanism configured to expose an opening formed through the ink cartridge, such that the pressure inside the ink chamber equalizes with the atmospheric pressure via the opening before the needle is inserted into the ink supply portion. Nevertheless, in certain situations, e.g., when the user inserts the ink cartridge rapidly or at an angle greater than a predetermined angle, the mechanism may fail to expose the opening before the needle is inserted into the ink supply portion. Consequently, the pressure inside the ink chamber and the pressure outside the ink chamber may not be equalized before the ink cartridge is mounted to the recording apparatus.

Yet another known ink cartridge has a valve mechanism configured to selectively open and close an opening formed through the ink cartridge. This known ink cartridge also has a cover member covering the opening and the valve mechanism. With this cover member, the valve mechanism is prevented from being opened inadvertently. Nevertheless, before a user mounts the ink cartridge to a recording apparatus, the user needs to remove the cover member from the ink cartridge, and also the valve mechanism needs to be opened before a needle of the recording apparatus is inserted into an ink supply portion of the ink cartridge.

SUMMARY OF THE INVENTION

Therefore, a need has arisen for ink cartridge assemblies which overcome these and other shortcomings of the related art. A technical advantage of the present invention is that an opening of the ink cartridge readily may be opened when a cover member is removed from the ink cartridge before the ink cartridge is mounted to a recording apparatus.

According to an embodiment of the present invention, an ink cartridge assembly comprises an ink cartridge comprising a body defining an ink chamber therein, and a sealing member. The body has a particular face, and the particular face has a particular opening formed therethrough. An interior of the ink chamber is configured to be in fluid communication with an exterior of the ink chamber via the particular opening, and the sealing member is configured to close the particular opening. The ink cartridge assembly also comprises a cover member comprising a first portion configured to engage the body, and a second portion. The cover member is configured to attached to the ink cartridge and to cover the particular opening when the first portion engages the body. When the second portion moves, the second portion is configured to apply a particular force to the sealing member to move the sealing member in a predetermined direction away from the particular opening and toward the ink chamber to facilitate fluid communication between the interior of the ink chamber and the exterior of the ink chamber, and is configured to disengage the first portion from the body.

Other objects, features, and advantages of embodiments of the present invention will be apparent to persons of ordinary skill in the art from the following description of preferred embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Embodiments of the present invention and their features and technical advantages may be understood by referring to FIGS. 1(A)-25(C), like numerals being used for like corresponding portions in the various drawings.

Figure 1A:
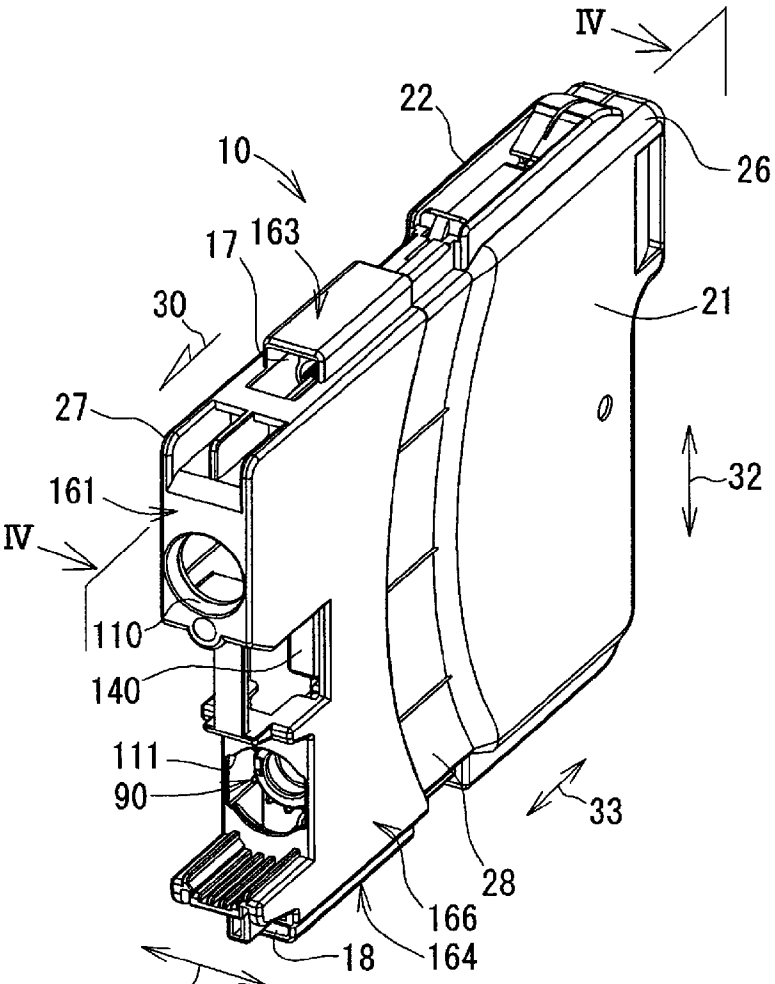
FIGS. 1(A) and 1(B) are a front-face perspective view and a rear-face perspective view of an ink cartridge, respectively, according to an embodiment of the present invention.
Figure 1B:
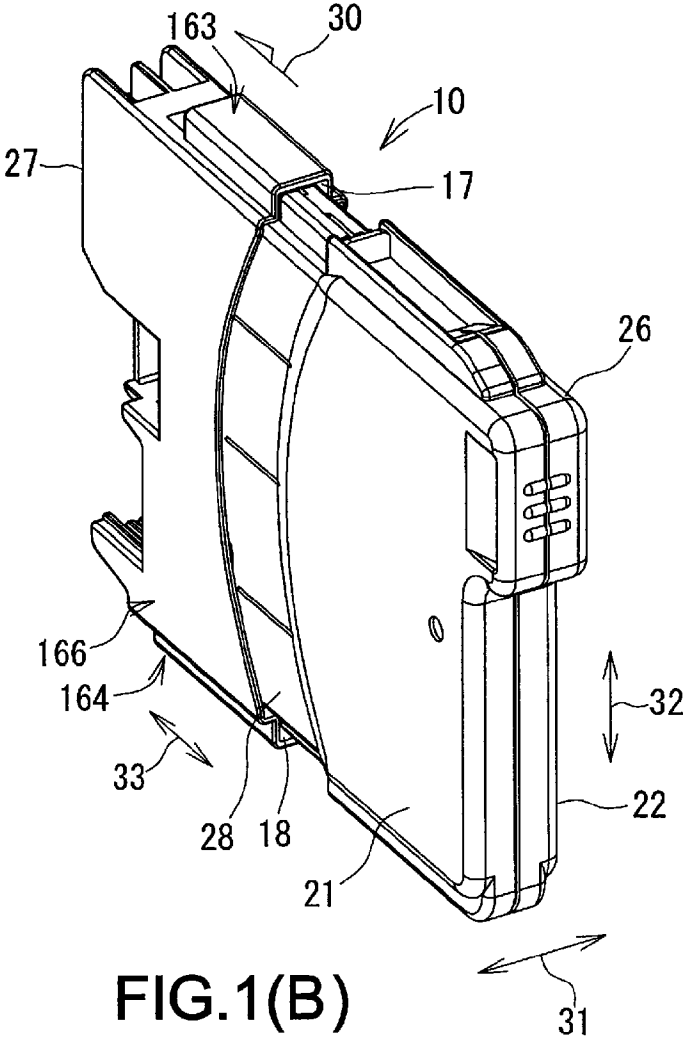
Figure 2:
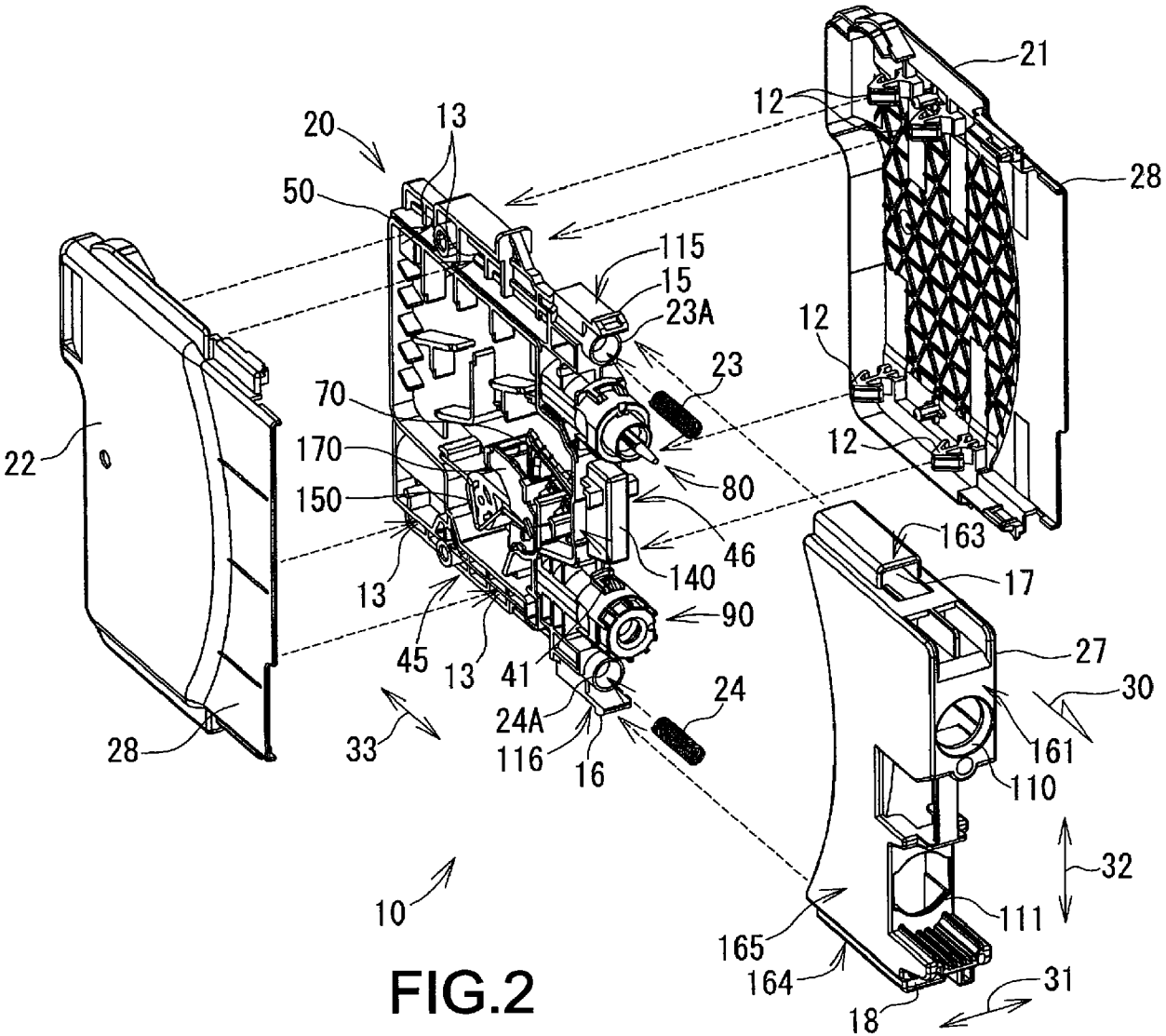
FIG. 2 is an exploded, perspective view of the ink cartridge of FIGS. 1(A) and 1(B).

Referring to FIGS. 1(A) and 1(B), an ink cartridge 10, according to an embodiment of the present invention, is depicted. An image recording apparatus (not shown), e.g., an inkjet printer, may use ink cartridge 10 to form an image on a recording medium (not shown), e.g., paper. The ink cartridge 10 is configured to be mounted to and removed from a cartridge storage section (not shown) of the image recording apparatus. The ink cartridge 10 may be mounted to the cartridge storage section by inserting ink cartridge 10 in a direction indicated by an arrow 30 in FIG. 1. After the ink cartridge 10 is mounted in the cartridge storage section, ink stored in the ink cartridge 10 may be supplied to a recording head (not shown) of the image recording apparatus.

The ink cartridge 10 may have a substantially flat, hexahedron shape. A width of the ink cartridge 10, as indicated by an arrow 31, may be relatively short, and each of a height of the ink cartridge 10, as indicated by an arrow 32, and a depth of the ink cartridge 10, as indicated by an arrow 33, may be greater than the width of the ink cartridge 10.

Referring to FIGS. 1(A)-3(B), the ink cartridge 10 may comprise a container body 20, a housing 26, a movable member, e.g., a slider 27, and at least one resilient member, e.g., a pair of coil springs 23 and 24. The housing 26 and the slider 27 may enclose the container body 20.

The housing 26 is configured to protect the container body 20. Substantially the entirety of the container body 20 other than a front face 41 of the container body 20 may be covered by the housing 26. The housing 26 may comprise a first cover member 21 and a second cover member 22 configured to sandwich the container body 20 from the right and left in FIG. 2. In an embodiment, a pair of films 65 may be covered by the first cover member 21 and the second cover member 22.

The first cover member 21 is attached to a right side face 46 of the container body 20. The first cover member 21 may comprise a plurality of engaging claws 12 extending from an inner wall surface thereof, and the container body 20 may comprise a plurality of engaging grooves 13 formed therein. The plurality of engaging claws 12 may be fitted into the plurality of engaging grooves 13, respectively, such that the right side face 46 of the container body 20 is covered by the first cover member 21. Similarly, the second cover member 22 is attached to a left side face 45 of the container body 20. The second cover member 22 comprises a plurality of engaging claws (not shown) extending from an inner wall surface thereof, and the plurality of engaging claws are fitted in the plurality of engaging grooves 13, respectively, such that the left side face 45 of the container body 20 is covered by the second cover member 22.

The container body 20 may comprise a sealing member, e.g., an air communication valve mechanism 80, and an ink supply valve mechanism 90 positioned at the front face 41 thereof. The slider 27 is configured to protect the air communication valve mechanism 80 and the ink supply valve mechanism 90. The slider 27 may be coupled to the container body 20 by the coil springs 23 and 24 positioned therebetween, and is configured to move relative to the container body 20. An end of the coil spring 23 is received in a spring receiver 23A formed in an upper portion of the front face 41 of the container body 20, and an end of the coil spring 24 is received in a spring receiver 24A formed in a lower portion of the front face 41 of the container body 20.

Figure 3A:
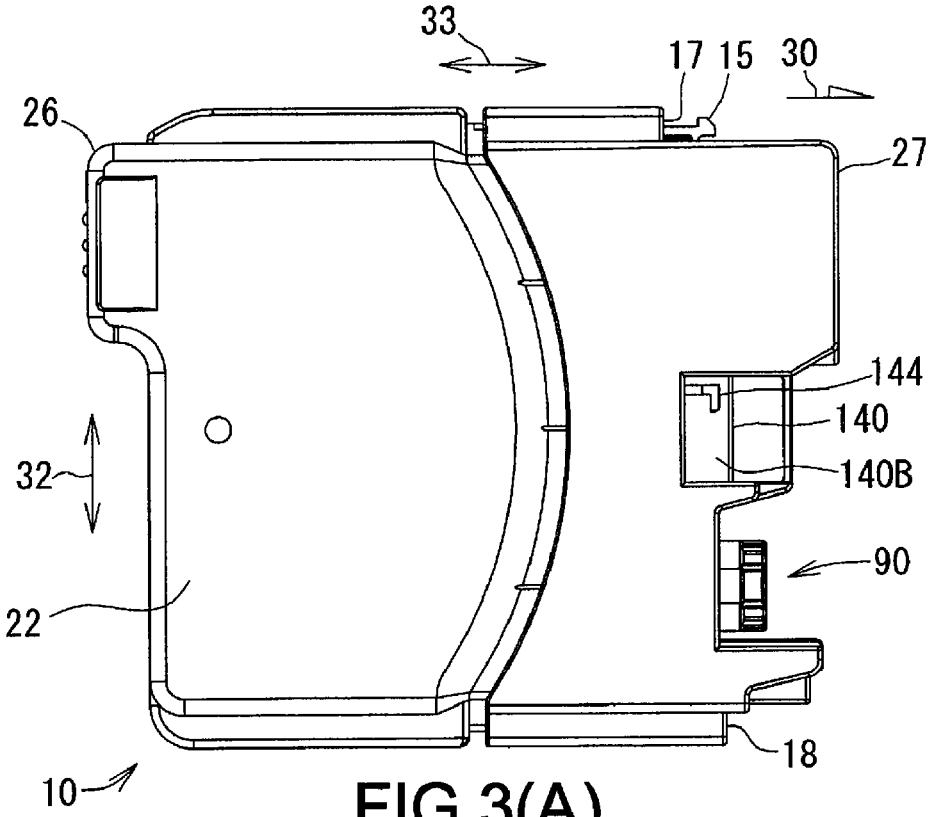
FIGS. 3(A) and 3(B) are side views of the ink cartridge of FIGS. 1(A) and 1(B), respectively, in which a movable member, such as a slider, is in a second position and a first position, respectively.
Figure 3B:
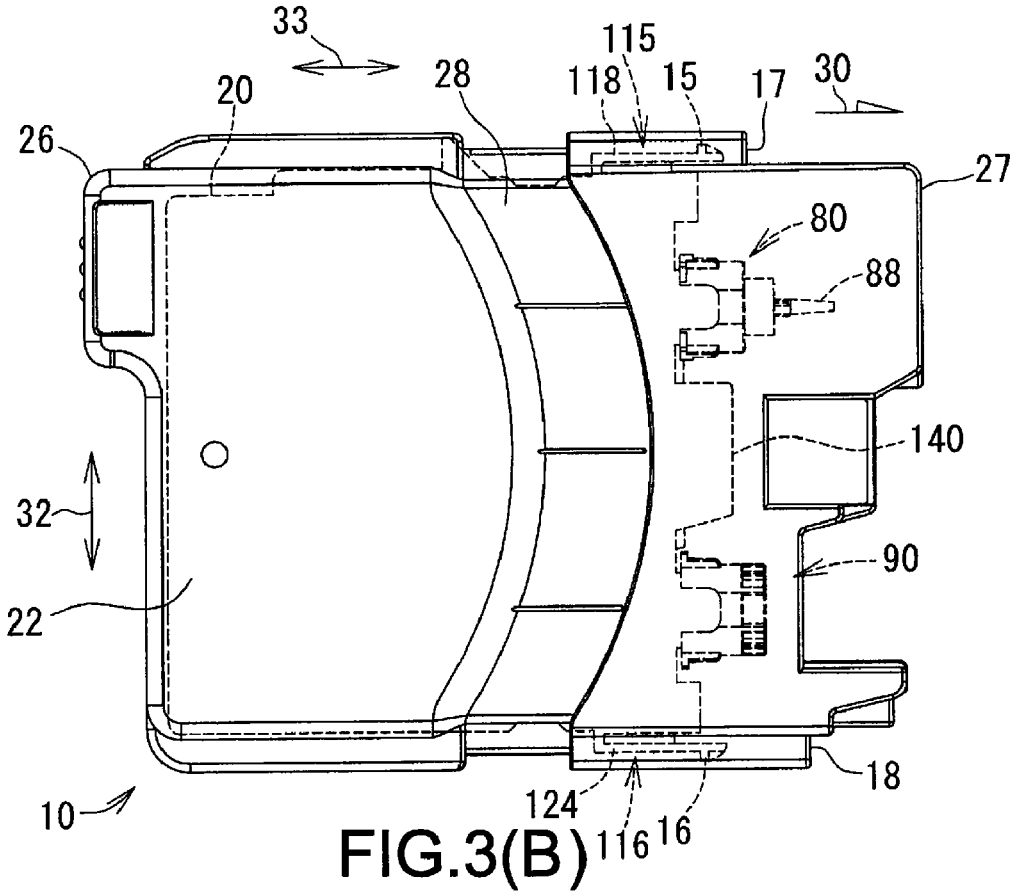
Figure 4:
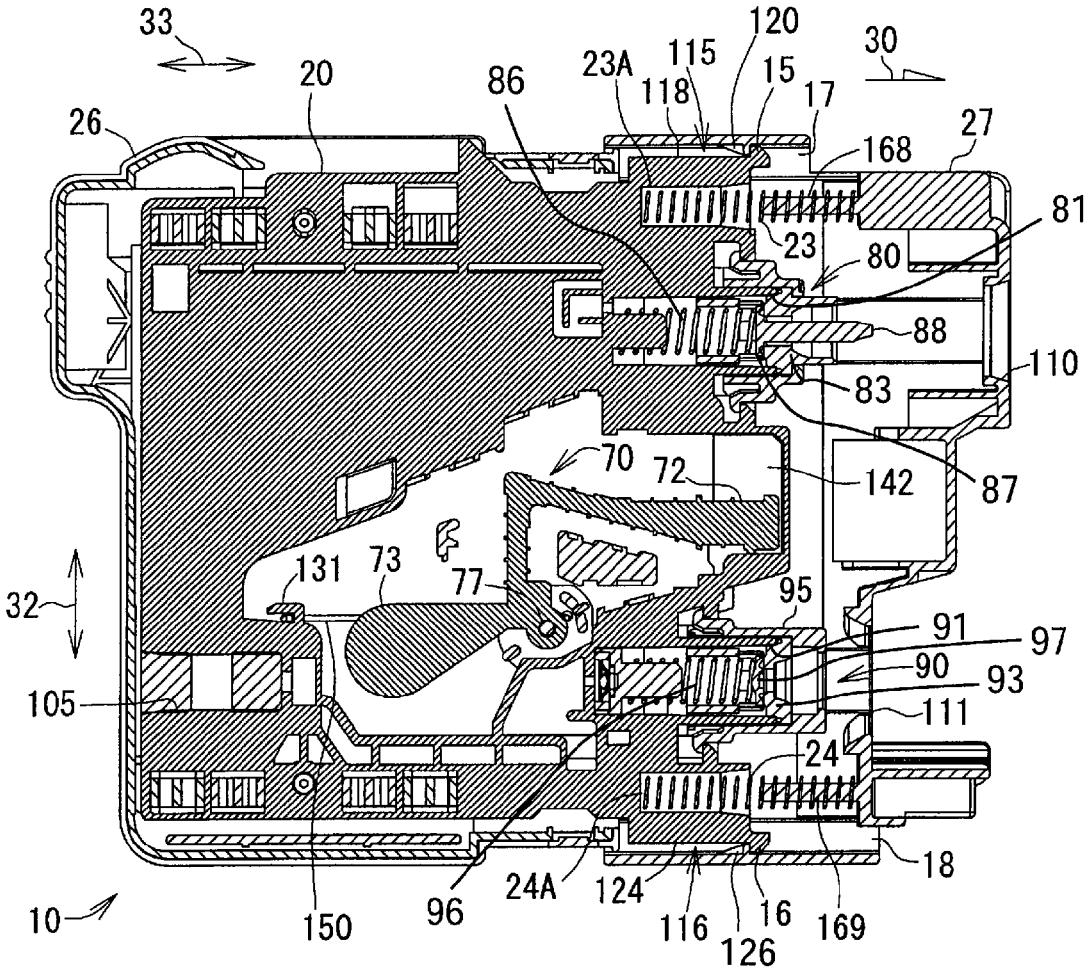
FIG. 4 is a cross-sectional view of the ink cartridge taken along a IV-IV line in FIG. 1(A).
Figure 5:
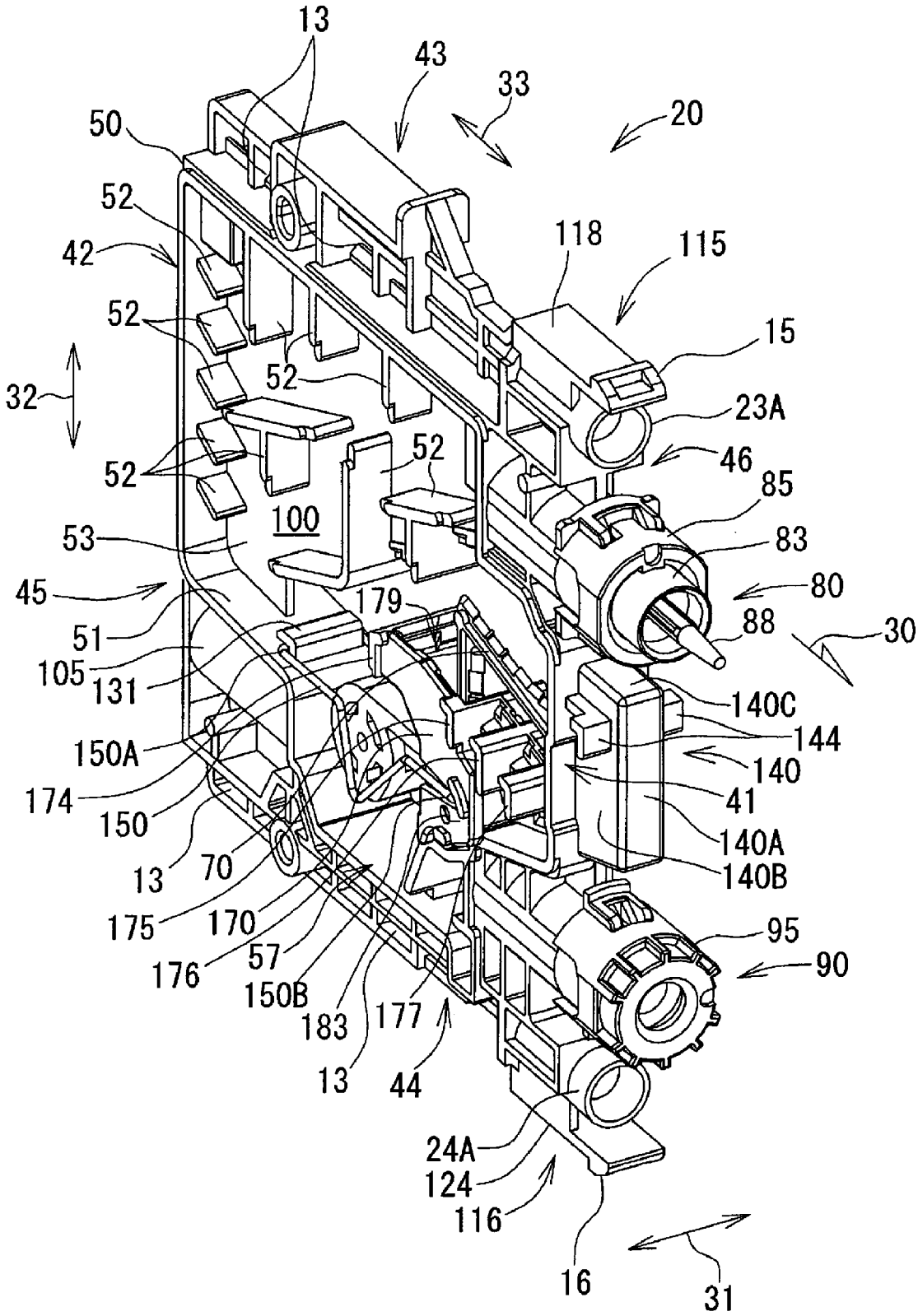
FIG. 5 is a perspective view of a container body, according to an embodiment of the present invention.

The slider 27 may be configured to contact and slide on the front portion 28 of the housing 26 between a first position and a second position in the depth direction, as indicated by the arrow 33, when coil springs 23 and 24 expand and contract. When the slider 27 is at the second position, as depicted in FIG. 3(A), the slider 27 is positioned closer to the front face 41 of the container body 20 than when the slider 27 is in the first position, and when the slider 27 is at the first position, as depicted in FIG. 3(B), the slider 27 is positioned further from the front face 41 of the container body 20 than when the slider 27 is in the second position. When a predetermined amount of force greater than a biasing force of the coil springs 23 and 24 is applied to the slider 27, the slider 27 moves from the first position to the second position. When the slider 27 is in the second position, an opening 110 formed through the slider 27 is positioned adjacent to the air communication valve mechanism 80, and the ink supply valve mechanism 90 extends outside the slider 27 via an opening 111 formed through the slider 27.

When the predetermined amount of force is released from the slider 27, the slider 27 subsequently moves from the second position to the first position, the opening 110 of the slider 27 moves away from the air communication valve mechanism 80, and the ink supply valve mechanism 90 is positioned within the slider 27.

Referring to FIGS. 4-10, the container body 20 may have a substantially flat, hexahedron shape having the front face 41, a rear face 42 opposite the front face 41, a top face 43, a bottom face 44 opposite top face 43, the left side face 45, and the right side face 46 opposite the left side face 45. Each of the top face 43 and the bottom face 44 is connected to the front face 41 and the rear face 42, and each of the left side face 45 and the right side face 46 is connected to the front face 41, the rear face 42, the top face 43, and the bottom face 44. Moreover, the area of the left side face 45 and the area of the right side face 46 are each greater than each of the area of the front face 41, the area of the rear face 42, the area of the top face 43, and the area of the bottom face 44.

The container body 20 may comprise a frame 50, a pivotable member 70, a supporting member, e.g., a supporting block 170, a protecting member 150, the air communication valve mechanism 80, the ink supply valve mechanism 90, and the pair of films 65. The frame 50 defines the six faces 41-46 of the container body 20, such that the six faces 41-46 of the container body 20 correspond to six faces of the frame 50.

The frame 50 may comprise a translucent resin material, e.g., a transparent material or a semi-transparent material, and light may pass therethrough. In this embodiment, the frame 50 may be manufactured by injection-molding polypropylene. Alternatively, the frame 50 may be manufactured by injection-molding polyacetal, nylon, polyethylene, or the like.

The frame 50 may comprise an outer peripheral wall 51 and a plurality of inner walls or inner ribs 52. The inner walls or inner ribs 52 are positioned inside the outer peripheral wall 51. The outer peripheral wall 51 and the inner walls or inner ribs 52 may be integral and may define the frame 50. The outer peripheral wall 51 and the inner walls or inner ribs 52 extend from the left side face 45 to the right side face 46 of the frame 50. The outer peripheral wall 51 may have a substantially square or rectangular perimeter extending along the front face 41, the top face 43, the rear face 42, and the bottom surface 44 defining a space in the interior thereof. Accordingly, openings 57 are formed on the left side face 45 and the right side face 46, respectively, of the frame 50, such that the left side face 45 and the right side face 46 of the frame 50 are opened.

The pair of films 65, e.g., translucent films, may be connected to, e.g., adhered to, the side faces 45 and 46, respectively, of the frame 50 via an adhesion method, e.g., a thermal adhesion method. More specifically, the pair of films 65 may be adhered to both ends of the outer peripheral wall 51 in the width direction 31. The openings 57 may be closed by the pair of films 65, and a space surrounded by the outer peripheral wall 51 and the pair of films 65 comprises an ink chamber 100 configured to store ink therein. Alternatively, a container-shaped frame which is opened on the right side face 46 may be used instead of the frame 50. In this case, the ink chamber 100 is defined by the film 65 adhered to the right side face 46 of the container-shaped frame.

The frame 50 may comprise a partitioning member, e.g., a partitioning plate 53, extending from the outer peripheral wall 51, which may partition an upper space of the ink chamber 100 at the center in the width direction 31. The inner walls or inner ribs 52 extend from the outer peripheral wall 51 or the partitioning plate 53. The pair of films 65 also may be adhered to the inner walls or inner ribs 52 at both ends thereof in the width direction 31. Consequently, the inner walls or inner ribs 52 may restrict the ability of the pair of films 65, the first cover member 21, and/or the second cover member 22 to move inward, such that the inner walls or inner ribs 52 may limit an amount of deformation of the pair of films 65. A lower portion of the ink chamber 100, e.g., a space 102 below the partitioning panel 53, may not be partitioned in the width direction 31 and may extend from the left side face 45 to the right side face 46, such that the pivotable member 70 and the supporting block 170 are positioned therein.

In an embodiment, each of the pair of films 65 may comprise a plurality of layered, synthetic resin films. For example, each of the pair of films 65 may comprise three layers. The innermost layer may comprise a polypropylene, and may comprise the same material as the frame 50. The innermost layer of the pair of films 65 may be adhered to the frame 50. The outermost layer may comprise a polyethylene terephthalate, and the layer sandwiched by the innermost layer and the outermost layer may comprise a nylon. In another embodiment, each of the pair of films 65 may comprise a metal foil sandwiched by synthetic resins. In yet another embodiment, each of the pair of films 65 may comprise a pulp, a metal, or a natural resin.

The frame 50 may comprise a rib 74 positioned at a right-side face 46 side of the outer peripheral wall 51, such that the rib 74 is positioned adjacent to a corner between the front face 41 and the bottom face 44. A cylindrical tube 67 extends from the rib 74 towards the left side face 45. A shaft 77 having a column shape may have a first end fitted into the cylindrical tube 67, and a second end which is supported by the supporting block 170. The shaft 77 extends through a shaft hole 78 of the pivotable member 70.

The frame 50 may comprise a cylindrical ink introduction chamber 105 formed in the rear face 42 of the frame 50 adjacent to the lower end of the rear face 42. The ink introduction chamber 105 extends from the rear face 42 towards the ink chamber 100. The ink introduction chamber 105 is configured to be in fluid communication with the ink chamber 100. Ink is introduced into the ink chamber 100 through the ink introduction chamber 105 during the manufacturing process of the ink cartridge 10. More specifically, air is removed from the interior of the ink chamber 100 until the pressure in the ink chamber 100 is reduced to a predetermined pressure. Because of the pressure differential between the interior and the exterior of the ink chamber 100, when a needle (not shown) is inserted into the ink introduction chamber 105, ink is drawn into the ink chamber 100 via the ink introduction chamber 105. As ink is drawn into the ink chamber 100, the pressure inside the ink chamber 100 increases. Nevertheless, the predetermined pressure is selected, such that after a sufficient amount of ink is introduced into the ink chamber 100 e.g., the ink chamber 100 is substantially full, the pressure in the ink chamber 100 is slightly less than the atmospheric pressure.

The frame 50 may comprise a translucent portion 140 positioned at the front face 41 and extending away from the ink chamber 100. An amount of ink stored in the ink chamber 100 may be optically or visually detected via the translucent portion 140. The translucent portion 140 may be integral with frame 50, and may comprise the same material as frame 50, e.g., the translucent portion 140 may comprise a translucent resin material which allows light to pass therethrough.

The translucent portion 140 may project outward from a center portion of front face 41 of the frame 50 away from the ink chamber 100. The translucent portion 140 may comprise five rectangular walls and have a substantially a hollow box shape. For example, the translucent portion 140 may comprise a front wall 140A, a pair of side walls 140B, a top wall 140C, and a bottom wall 140D. The front wall 140A extends parallel to the front face 41 and is separated from the front face 41 by a predetermined distance. The pair of side walls 140B are connected to the front face 41 and the front wall 140A, the top wall 140C is connected to top ends of the front wall 140A and the side walls 140B, and the bottom wall 140D is connected to bottom ends of the front wall 140A and the side walls 140B. Moreover, the width of the front wall 140A is less than the width of the front face 41. The translucent portion 140 is configured to receive light emitted from an optical sensor, e.g., a photo interrupter. When ink cartridge 10 is mounted to the image forming apparatus, a light emitting portion of a photo interrupter may face one of the side walls 140B and a light receiving portion of the photo interrupter may face the other of the side walls 140B. The light emitted from the light emitting portion of the photo interrupter may pass through the side walls 140B and reach the light receiving portion of the photo interrupter.

The translucent portion 140 may have an inner space 142 formed therein, which is defined by the front wall 140A, the side walls 140B, the top wall 140C, and the bottom wall 140D of the translucent portion 140. The inner space 142 is configured to be in fluid communication with the interior of the ink chamber 100. An indicating portion 72, e.g., a signal blocking portion, of the pivotable member 70 may be configured to move within the inner space 142 between an upper position and a lower position based on an amount of ink in the ink chamber 100.

At least one engaging claw 144 may be formed on each of the side walls 140B of the translucent portion 140. Each engaging claw 144 extends outward from one of the side walls 140B in a direction perpendicular to the side walls 140B. Each engaging claw 144 may have a hook shape.

When the ink cartridge 10 is mounted to the image forming apparatus, the air communication valve mechanism 80 is positioned above the translucent portion 140. The air communication valve mechanism 80 is configured to selectively open and close an opening 81 formed through an upper portion of the front face 41 of the frame 50, such that air communication valve mechanism 80 selectively allows and prevents fluid communication between the interior of the ink chamber 100 and the exterior of the ink chamber 100 via the opening 81. The air communication valve mechanism 80 may comprise a valve member 87, a rod 88 extending from the valve member 87, an urging member, e.g., a spring 86, a stopper 83, and a cap 85.

The stopper 83 has an opening formed therethrough. The stopper 83 is partially positioned in the opening 81, but does not close the opening 81 completely because the opening is formed through the stopper 83. The valve member 87 is configured to move between an opened position in which the valve member 87 is separated from the stopper 83, and a closed position in which the valve member 87 contacts the stopper 83. When the valve member 87 is positioned in the opened position, the opening of the stopper 83 is not closed by the valve member 87, such that the opening 81 is opened. When the valve member 87 is positioned in the closed position, the opening of the stopper 83 is closed, such that the opening 81 is closed. The valve member 87 is resiliently urged by the spring 86 toward the stopper 83, such that the valve member 87 is in the closed position unless a force substantially opposite and greater than the biasing force of the spring 86 is applied to the valve member 87.

When the ink cartridge 10 is mounted to the image forming apparatus, the ink supply valve mechanism 90 is positioned below the translucent portion 140. The ink supply valve mechanism 90 may be configured to selectively open and close an opening 91 formed through a lower portion of the front face 41 of the frame 50, such that the ink supply valve mechanism 90 selectively allows and prevents fluid communication between the interior of the ink chamber 100 and the exterior of the ink chamber 100 via the opening 91. The ink supply valve mechanism 90 may comprise a valve member 97, a spring 96, a spring receiver 94, a stopper 93, and a cap 95. The stopper 93 has an opening formed therethrough. The stopper 93 is partially positioned in the opening 91, but does not close the opening 91 completely because the opening is formed through the stopper 93. The valve member 97 is configured to move between an opened position in which the valve member 97 is separated from the stopper 93, and a closed position in which the valve member 97 contacts the stopper 93. When the valve member 97 is positioned in the opened position, the opening of the stopper 93 is not closed by the valve member 97, such that the opening 91 is opened. When the valve member 97 is positioned in the closed position, the opening of the stopper 93 is closed, such that the opening 91 is closed. The valve member 97 is resiliently urged by the spring 96 toward the stopper 93, such that the ink supply valve mechanism 90 is in the closed position unless a force substantially opposite and greater than the biasing force of the spring 96 is applied to the valve member 97. When the ink cartridge 10 is mounted to the image recording apparatus, the valve member 97 is pushed by a tube of the image recording apparatus against the biasing force of the spring 96, and the opening 91 is opened. Consequently, ink in the ink chamber 100 is allowed to flow from the opening 91 to the image recording apparatus via the tube.

A supporting member 115 may be positioned on the top face 43 of the frame 50 adjacent to the front face 41 of the frame 50. The supporting member 115 may be integral with the frame 50. The supporting member 115 is configured to support the slider 27, such that the slider 27 slides with respect to the container body 20. The supporting member 115 also is configured to restrict the sliding range of the slider 27. The slider 27 may be slidably supported by the supporting member 115 and a supporting member 116. The supporting member 115 may comprise a seat 118 extending away from the top face 43 in a direction perpendicular to the top face 43, and a hook-shaped engaging claw 15 which is positioned at and extends from the front end of the seat 118 in a direction perpendicular to the top face 43.

The supporting member 116 may be formed on the bottom face 44 of the frame 50 adjacent to the front face 41 of the frame 50. The supporting member 116 may have substantially the same shape as the supporting member 115. The supporting member 116 may be integral with the frame 50, and may comprise a seat 124 extending away from the bottom face 44 in a direction perpendicular to the bottom face 44, and a hook-shaped engaging claw 16 which is positioned at and extends from the front end of the seat 124 in a direction perpendicular to the bottom face 44.

Figure 6:
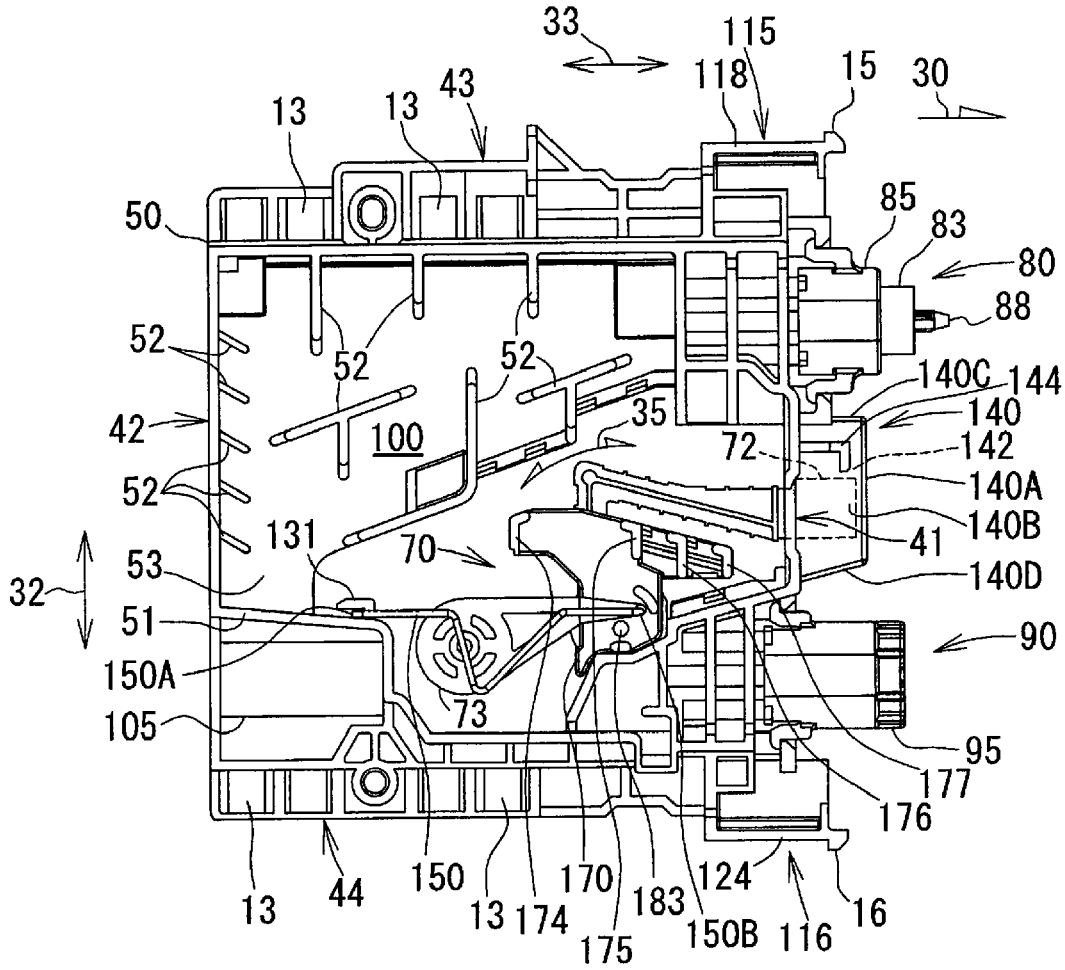
FIG. 6 is a side view of the container body of FIG. 5.
Figure 7:
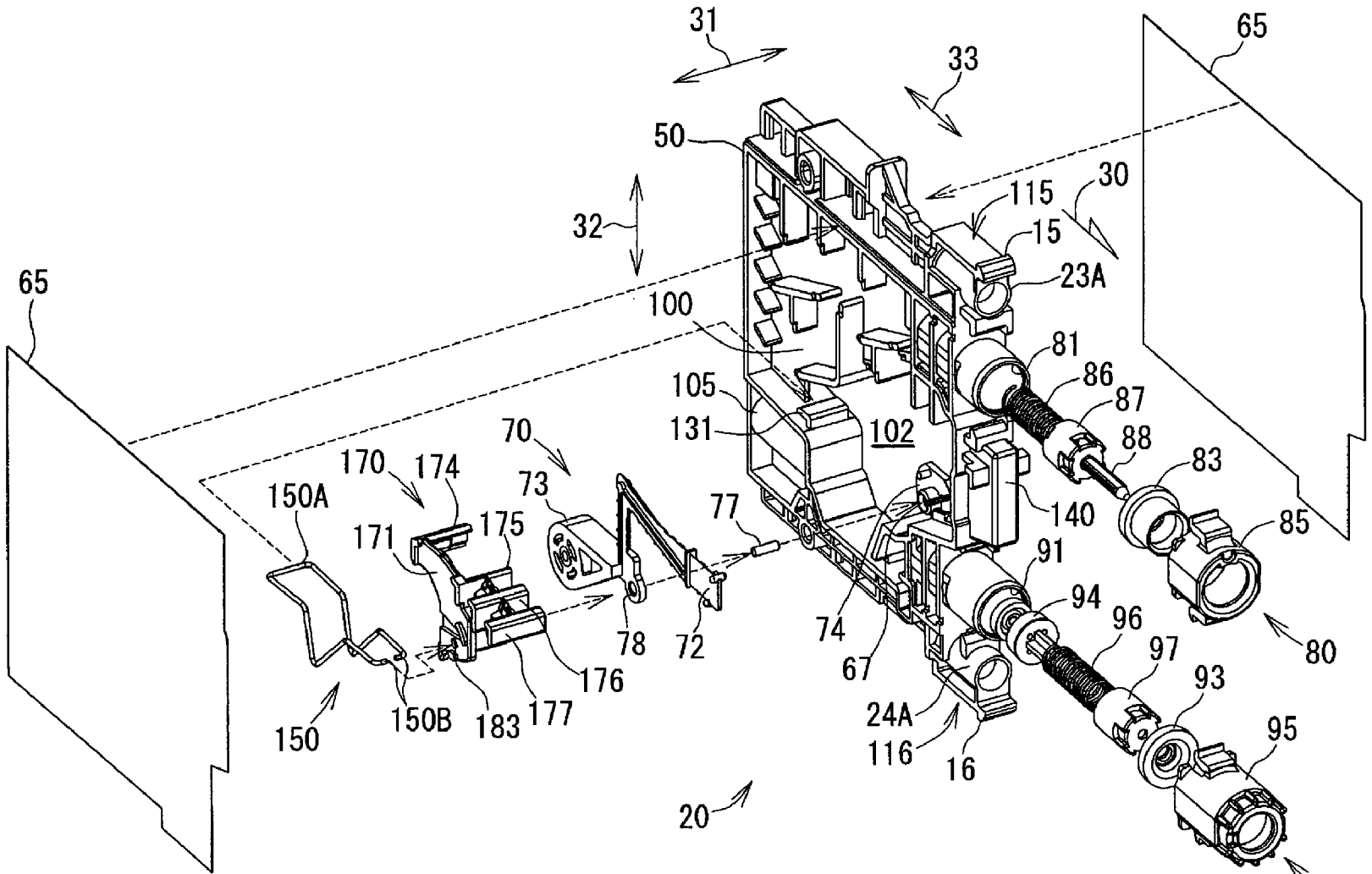
FIG. 7 is an exploded, perspective view of container body of FIG. 5, in which the container body comprises a pair of film walls.
Figure 8:
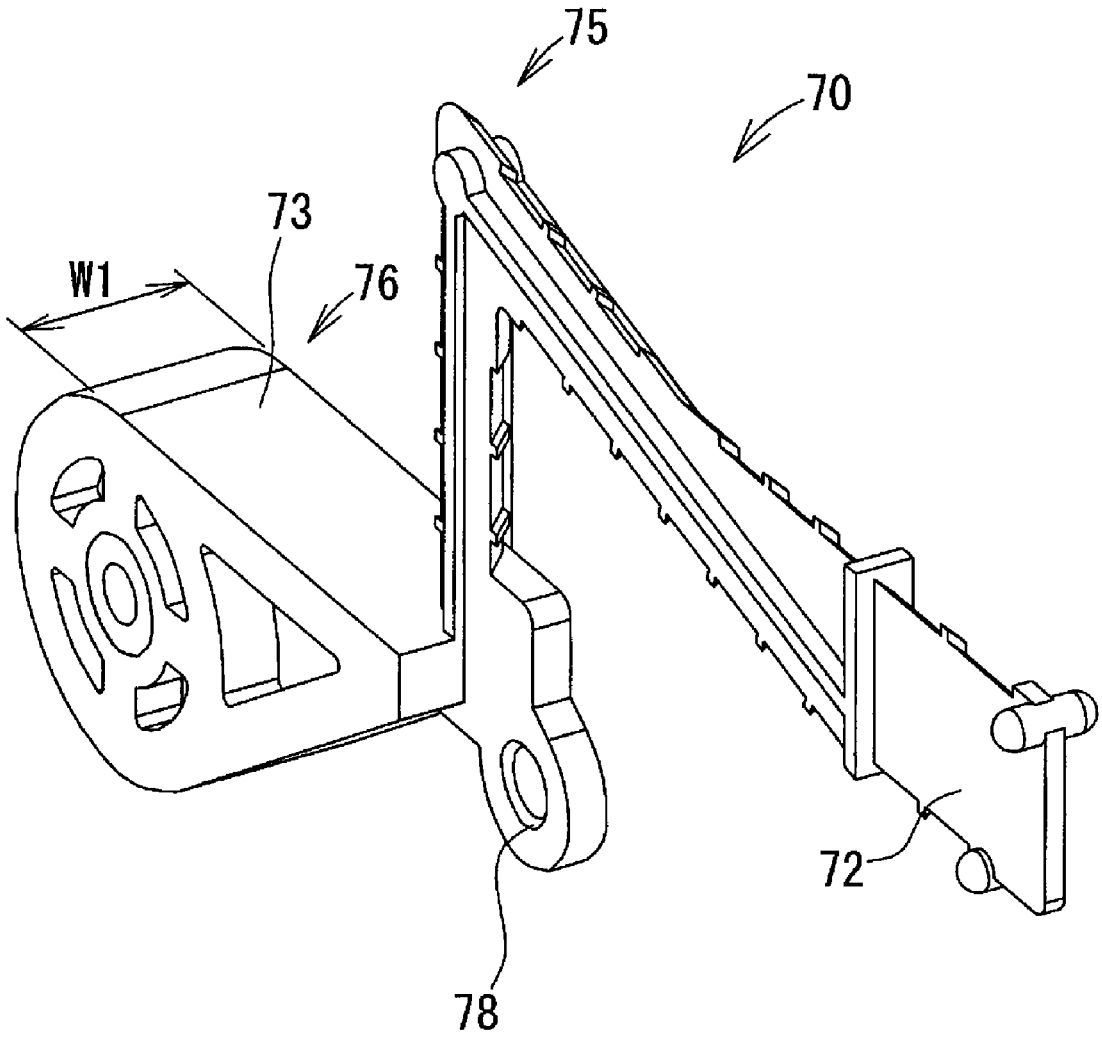
FIG. 8 is a perspective view of a pivotable member, according to an embodiment of the present invention.

Referring to FIGS. 6-8, the pivotable member 70 is configured to indicate whether the ink chamber 100 has a sufficient amount of ink stored therein. The indicating portion 72 is positioned at a first end of the pivotable member 70, and a float portion 73 is positioned at a second end of the pivotable member 70.

The pivotable member 70 has the shaft hole 78 formed therethrough. The shaft hole 78 may be positioned between the first end of the pivotable member and the second end of the pivotable member. The shaft 77 is inserted into the shaft hole 78, and the shaft 77 may support the pivotable member 70, such that the pivotable member 70 pivots about the shaft 77 in a direction indicated by an arrow 35 in FIG. 6. The shaft 77 is supported by the cylindrical tube 67 formed on the rib 74 at one end thereof, and by the supporting block 170 at the other end thereof. Alternatively the shaft 77 may be integral with the pivotable member 70.

The specific gravity of float portion 73 is less than the specific gravity of ink stored in the ink chamber 100. The float portion 73 may have a hollow formed therein, and floats on liquid, such that the float portion 70 moves upward and downward based on the amount of ink within the ink chamber 100, and the pivotable member 70 pivots based on the movement of float portion 73. In another embodiment, the float portion 73 does not have the hollow, and comprises a material having a specific gravity less than the specific gravity of ink.

When the pivotable member 70 pivots clockwise in FIG. 6, the indicating portion 72 contacts the bottom wall 140D of the translucent portion 140, such that further movement of the pivotable member 70 is prevented, and the indicating portion 72 is positioned at the lower position. Similarly, when the pivotable member 70 pivots counterclockwise in FIG. 6, the indicating portion 72 moves away from the bottom wall 140D of the translucent portion 140, and the float portion 73 contacts a bottom surface of the ink chamber 100. When the float portion 73 contacts the bottom surface of the ink chamber 100, further movement of the pivotable member 70 is prevented, and the indicating portion 72 is at the upper position and separated from the bottom wall 140D of the translucent portion 140 by a predetermined distance.

The pivotable member 70 may comprise a first portion 75 extending from the shaft hole 78 to the indicating portion 72, and a second portion 76 extending from the shaft hole 78 to the float portion 73. The mass of the first portion 75 of the pivotable member 70 may be less than the mass of the second portion 76 of the pivotable member 70, such that when the second portion 76 of the pivotable member 70 and the first portion 75 of the pivotable member 70 are in the same medium as each other, the second portion 76 of the pivotable member 70 is heavier than the first portion 75 of the pivotable member 70. Accordingly, when the amount of ink stored in the ink chamber is less than a sufficient amount of ink, the pivotable member 70 pivots counterclockwise about the shaft 77 in FIG. 6, and the indicating portion 72 separates from the bottom wall 140D of the translucent portion 140. When the lower end of the float portion 73 contacts the bottom surface of the ink chamber 100, the pivotable member 70 stops pivoting and the indicating portion 72 is positioned at the upper position. When the indicating portion 72 is at the upper position, it may be determined that the ink chamber 100 has an insufficient amount of ink stored therein.

In contrast, when a sufficient amount of ink is stored in the ink chamber 100, the float portion 73 is submerged in the ink, and a buoyancy force acts on the float portion 73. The buoyancy force is great enough to cause the pivotable member 70 to pivot clockwise about the shaft 77 in FIG. 6. When the pivotable member 70 pivots clockwise, the indicating portion 72 contacts the bottom wall 140D of the translucent portion 140, and the pivotable member 70 stops pivoting and the indicating portion 72 is positioned at the lower position. When the indicating portion 72 is at the lower position, it may be determined that the ink chamber 100 has a sufficient amount of ink stored therein.

Whether or not the ink chamber 100 has a sufficient amount of ink stored therein may be determined by a user viewing the position of the indicating portion 72 in the inner space 142, or by using an optical sensor e.g., a photo interrupter, to monitor the position of the indicating portion 72.

Referring to FIGS. 6 and 7, the protecting member 150 is positioned around the pivotable member 70. The protecting member 150 may be manufactured by bending a linear steel wire. The protecting member 150 may comprise a U-shaped portion 150A which may be received by a hook 131 formed on the frame 50, and ends 150B of the protecting member 150 may be inserted into a hole (not shown) formed through the rib 74 and a hole 183 formed through the supporting block 170, respectively.

Figure 9:
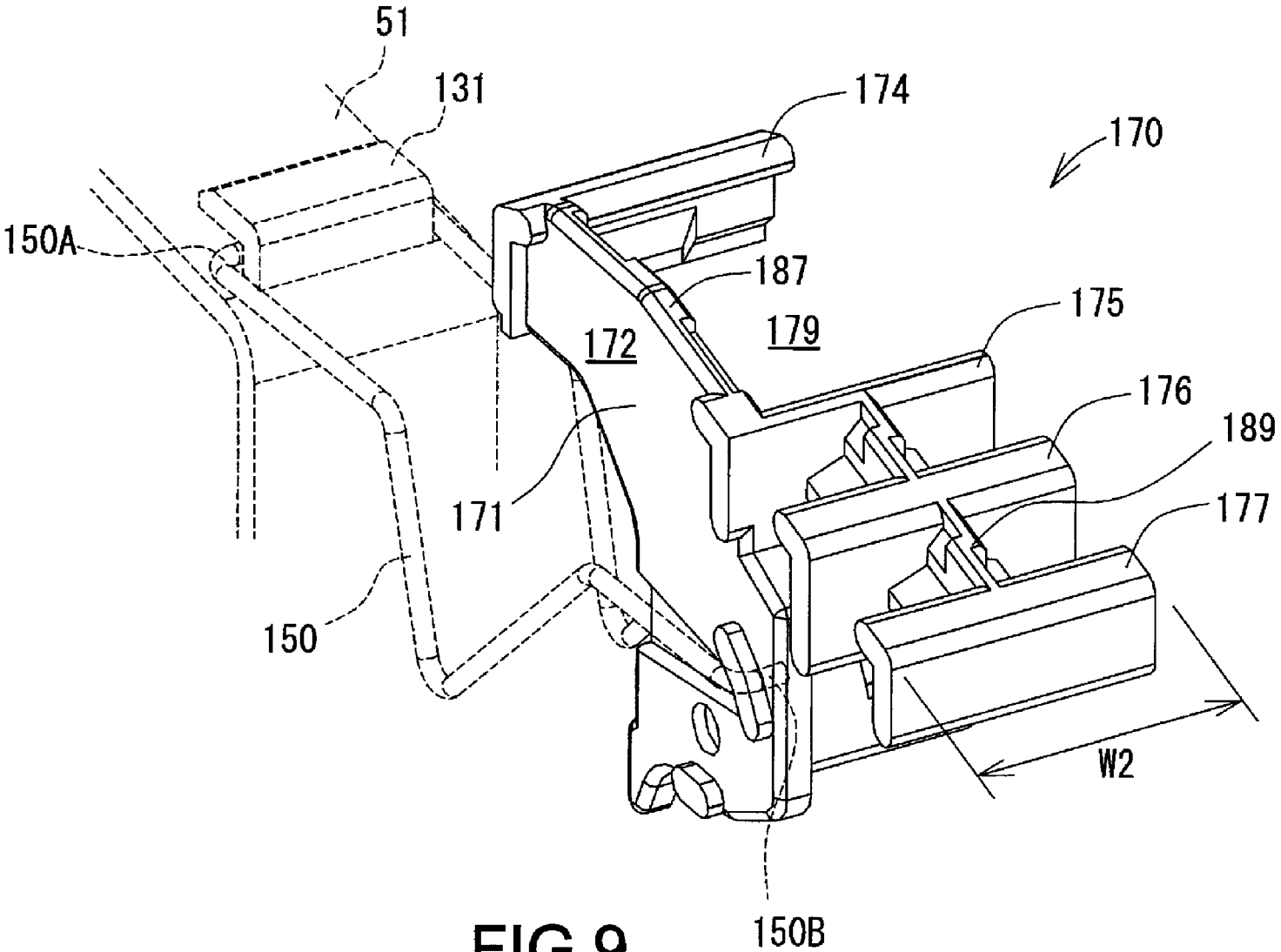
FIG. 9 is a perspective view of a supporting block, according to an embodiment of the present invention.

Referring to FIGS. 7, 9, and 10, the supporting block 170 is depicted. In FIG. 9, a portion of the outer peripheral wall 51 and a portion of the protecting member 150 are illustrated in broken lines for the convenience of description. The supporting block 170 is configured to support the shaft 77 and to support the pair of films 65 which may bend toward the ink chamber 100. The supporting block 170 is positioned in a lower portion of the ink chamber 100, e.g., in the space 102. The supporting block 170 may be configured to be removable from the frame 50.

The supporting block 170 may comprise a plate 171 and a plurality of ribs 174-177. The plate 171 and the ribs 174-177 may comprise the same material as the frame 50.

Figure 10D:
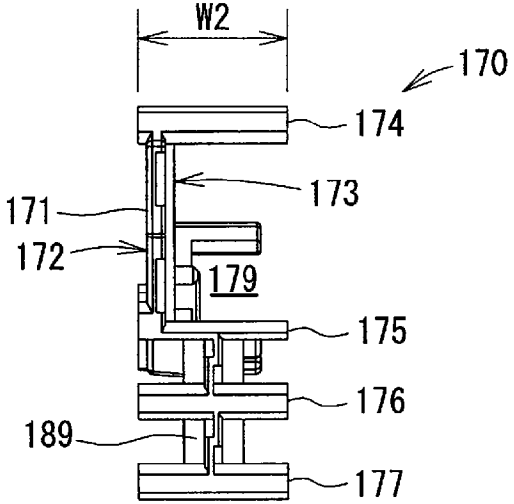
FIG. 10(D) is a plane view of the support block of FIG. 9.
Figure 10C:
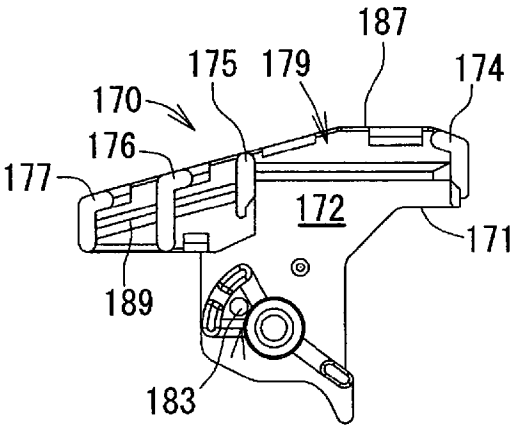
FIG. 10(C) is a right side view of the support block of FIG. 9.
Figure 10A:
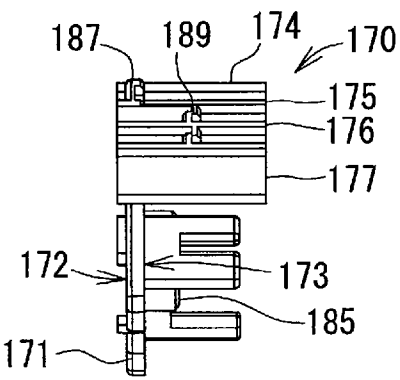
FIG. 10(A) is a front view of the support block of FIG. 9.
Figure 10B:
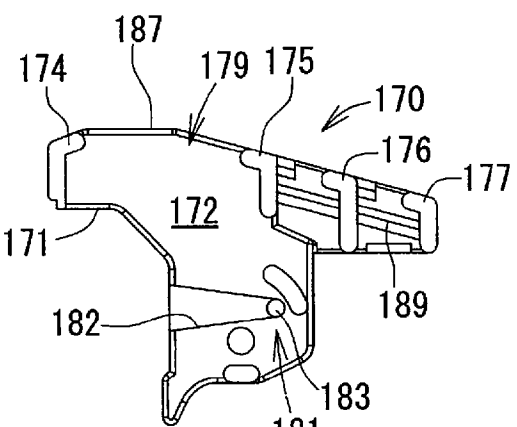
FIG. 10(B) is a left side view of the support block of FIG. 9.

The rib 174 and the rib 175 may extend in a direction perpendicular to a first surface 172 of the plate 171. Each of the ribs 174 and 175 may be substantially L-shaped, as shown in FIG. 10(B). The rib 174 and the rib 175 may be positioned adjacent to an upper end 187 of the plate 171. The rib 174 and the rib 175 are separated from each other by a predetermined distance. Consequently, an opening 179 which may have a substantially C-shape may be formed by the plate 171, the rib 174, and the rib 175. A portion of the first portion 75 of the pivotable member 70 may be positioned in the opening 179, and the pivotable member 70 may be pivotable within the range defined by the opening 179.

The supporting block 170 also may comprise a supporting portion 189 extending from the rib 175 substantially in the depth direction 33. The supporting portion 189 extends from substantially a widthwise center of the rib 175 toward the direction away from the rib 174. The rib 176 and the rib 177 may be positioned on the supporting portion 189. The rib 176 and the rib 177 are separated from each other by a predetermined distance. Therefore, the ribs 174-177 are positioned at dispersed places in the space 102.

Each of the rib 176 and the rib 177 may be substantially L-shaped. Each of the ribs 176 and 177 may extend in the same direction as the ribs 174 and 175 extend, and may have the same width W2 as the ribs 174 and 174. Each of the ribs 176 and 177 may extend the same distance from the supporting portion 189 in opposite directions.

The width W2 of the ribs 174-177 may be selected, such that the pair of films 65 do not contact the pivotable member 70 when the pair of films 65 are drawn toward the ink chamber 100. More specifically, the width W2 of the ribs 174 and 175 may be greater than a width W1 of the float portion 73, which is the portion of the pivotable member 70 which has the greatest width.

A groove 182 may be formed in a lower portion of the first surface 172 of the plate 172. The groove 182 may have a substantially triangular shape. A hole 183 may be formed through the plate 172 at a vertex 181 of the triangular groove 182. When one end 150B of the protecting member 150 is pushed along the groove 182 toward the vertex 181 with the supporting block 170 disposed in the space 102, the end 150B is guided to the vertex 181, and then is inserted into the hole 183. The end 150B of the protecting member 150 is thereby readily inserted into the hole 183.

A cylindrical tube 185 may be formed on a second surface 173 of the plate 172, and an end of the shaft 77 may be received in the cylindrical tube 185. The supporting block 170 is attached to the rib 74 with the second surface 173 facing the rib 74, such that the shaft 77 is inserted into the shaft hole 78 of the pivotable member 70, one end of the shaft 77 is received in the cylindrical tube 185 of the supporting block 170, and the other end of the shaft 77 is received in the cylindrical tube 67 of the rib 74. The pivotable member 70 is thereby pivotably supported, and a portion of the first portion 75 of the pivotable member 70 is positioned in the opening 179. Moreover, the ribs 174-177 extend perpendicular to and between the left side face 45 and the right side face 46.

Because the supporting block 170 is positioned in the space 102 of the ink chamber 100, even though the pair of films 65 are drawn towards the ink chamber 100 due to the pressure differential between the interior and exterior of the ink chamber 100 when ink is introduced into the ink chamber 100, the inner surfaces of the pair of films 65 contact ribs 174-177 of the supporting block 170. Therefore, deformation of the pair of films 65 is suppressed, which maintains the capacity of the ink chamber 100 at a maximum capacity. Moreover, when an external force is applied to the housing 26, which causes the housing 26 to deform toward the container body 20, the deformation of the housing 26 may be suppressed by the ribs 174-177.

Referring to FIGS. 1-4, the slider 27 is depicted. The slider 27 may have a container shape, and may be configured to accommodate a front portion of the container body 20 therein. The slider 27 may have a flat shape corresponding to the outer shape of the front portion of the container body 20. The slider may comprise a front wall 161 facing and covering the front face 41 of the container body 20, a top wall 163 covering at least a portion of the top face 43 of the container body 20, a bottom wall 164 covering at least a portion of the bottom face 44 of the container body 20, a left wall 165 covering at least a portion of the left side face 45 of the container body 20, and a right wall 166 covering at least a portion of the right side face 46 of the container body 20. A portion of the front portion 28 of the housing 26 may be positioned between the top wall 163 and the at least a portion of the top face 43, another portion of the front portion 28 may be positioned between the bottom wall 164 and the at least a portion of the bottom face 44, still another portion of the front portion 28 may be positioned between the left wall 165 and the at least a portion of the left side face 45, and yet another portion of the front portion 28 may be positioned between the right wall 166 and the at least a portion of the right side face 46. The walls 161, and 163-166 may define a space therein, which is configured to accommodate the front portion of the container body 20.

The slider 27 may comprise supporting bars 168 and 169, slide grooves 17 and 18, and the openings 110 and 111. The supporting bar 168 may be configured to support the coil spring 23, and the supporting bar 169 may be configured to support the coil spring 24. The supporting bars 168 and 169 may be positioned on a surface of the front wall 161 facing the front face 41 of the container body 20. The supporting bar 168 may be at a position corresponding to the spring receiver 23A, and the supporting bar 169 may be at a position corresponding to the spring receiver 24A.

The supporting bars 168 and 169 may extend from the surface of the front wall 161 in the depth direction 33 of the container body 20. When the front portion of the container body 20 is inserted into the slider 27 when the coil spring 23 is stored in the spring receiver 23A and the coil spring 24 is stored in the spring receiver 24A, the supporting bar 168 is inserted into the coil spring 23 and the supporting bar 169 is inserted into the coil spring 24. Accordingly, the coil springs 23 and 24 may be supported by the supporting bars 168 and 169, respectively. The direction of expansion and contraction of the coil springs 23 and 24 may be limited in the depth direction of the container body 20.

The coil springs 23 and 24 may comprise compression coil springs, e.g., the coil springs 23 and 24 may be compressed and stored in the spring receivers 23A and 24A, respectively, when the front portion of the container body 20 is inserted into the slider 27. Therefore, the coil springs 23 and 24 may urge or bias slider 27 in the direction away from the front face 41 of the container body 20 independent of the position of the slider 27.

The slide groove 17 may be formed in the top wall 163, and a cross-sectional shape of the slide groove 17 may have a substantially inverted U-shape. The supporting member 115 may be inserted into the slide groove 17, and a projecting strip 120 may extend from a bottom surface of the top wall 163 toward an interior of the slide groove 17. Therefore, the slide groove 17 may be narrowed by the projecting strip 120. The slide groove 18 may be formed in the bottom wall 164, and a cross-sectional shape of the slide groove 18 may be substantially a U-shape. The supporting member 116 may be inserted into the slide groove 18, and a projecting strip 126 may extend from a top surface of the bottom wall 164 toward an interior of the slide groove 18. Therefore, the slide groove 18 may be narrowed by the projecting strip 126.

During insertion of the front portion of the container body 20 into the slider 27, the supporting member 115 may be inserted into the slide groove 17, and the supporting member 116 may be inserted into the slide groove 18. When the supporting member 115 is inserted into the slide groove 17, the projecting strip 120 and the engaging claw 15 may contact each other. Then, when the supporting member 115 is further inserted, the supporting member 115 may bend downward, and the engaging claw 15 may move to be positioned over the projecting strip 120. When the engaging claw 15 has moved over the projecting strip 120, the slider 27 and the container body 20 may not be disassembled because the engaging claw 15 is received by the projecting strip 120. The supporting member 116 also may be inserted into the slide groove 18 in the same manner.

When the front portion of the container body 20 is inserted into the slider 27, the slider 27 is urged away from the front face 41 by the coil springs 23 and 24. Therefore, unless an external force is applied to the slider 27, the slider 27 remains in the first position, as shown in FIG. 3(B), corresponding to the slider's 27 furthest distance from front face 41 of the container body 20. The slider 27 remains in the first position by the contact between the projecting strip 120 and the engaging claw 15 and the contact between the projecting strip 126 and the engaging claw 16. Nevertheless, when an external force greater than the biasing force is applied to the front wall 161 of the slider 27, the slider 27 slides from the first position to the second position, as shown in FIG. 3(A), corresponding to the slider's 27 closest distance to front face 41 of the container body 20.

Figure 11:
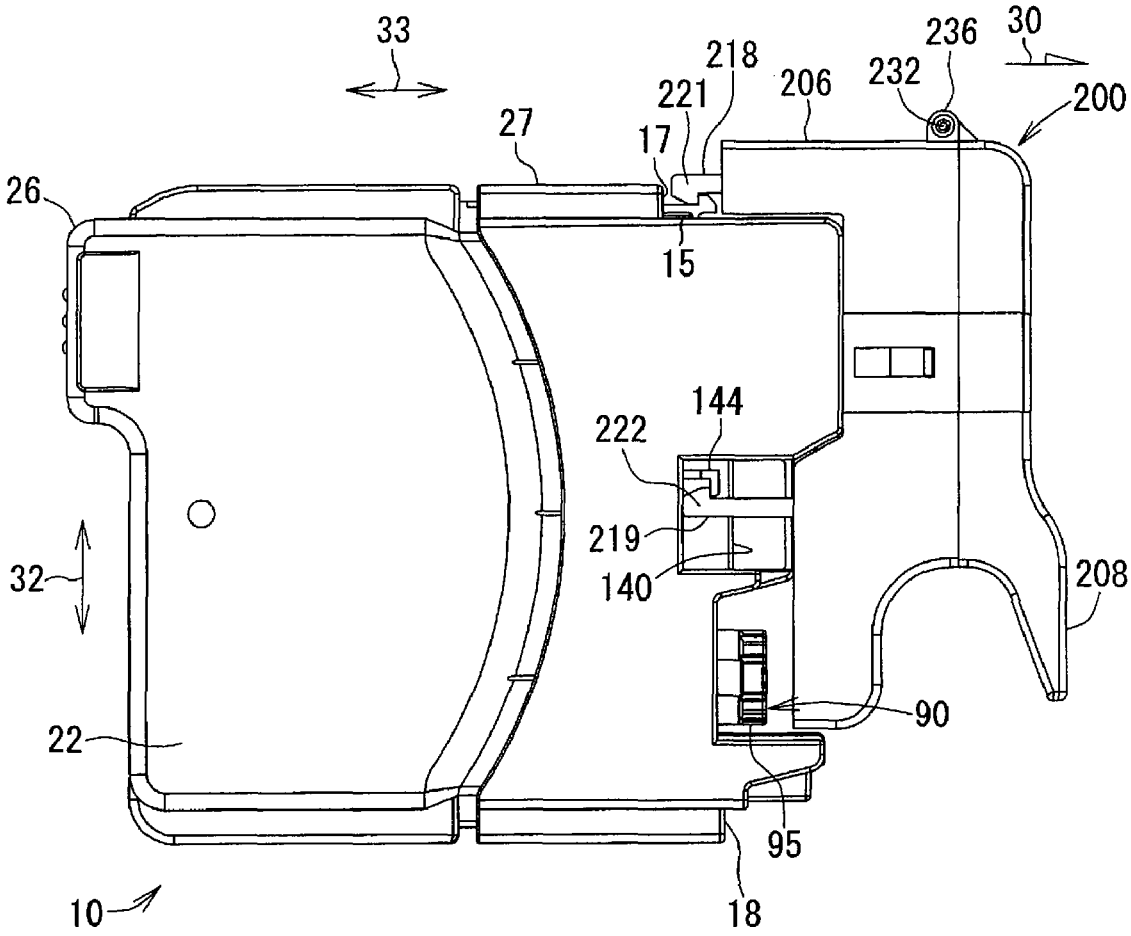
FIG. 11 is a side view of an ink cartridge assembly comprising an ink cartridge and an opener, according to an embodiment of the present invention.

The opening 110 may be formed through the front wall 161 adjacent to the upper end of the front wall 161. The opening 110 may be formed at a position corresponding to the air communication valve mechanism 80. The opening 110 may allow a guide 204 and a rod 244 of an opener 200 to be inserted therethrough, as shown in FIG. 11, and may have a substantially circular shape.

The opening 111 may be formed through the front wall 161 adjacent to the lower end of the front wall 161. The opening 111 may be formed at a position corresponding to the ink supply valve mechanism 90. The opening 111 may have a size which is sufficient to allow the cap 95 of the ink supply valve mechanism 90 to be inserted therein, and when the slider 27 is slid from the first position to the second position, the cap 95 emerges from the opening 111.

Referring to FIGS. 11-19, an ink cartridge assembly is depicted. The ink cartridge assembly comprises the ink cartridge 10 and an opener 200. The opener 200 may be configured to cover the air communication valve mechanism 80 and the ink supply valve mechanism 90 when the opener 200 is attached to the ink cartridge 10, and also may be configured to cause the air communication valve mechanism 80 to open the opening 81. The opener 200 may comprise a seat 206, a cover 208, an operation member 210, and a shaft 212.

The seat 206 may be configured to be directly attached to the ink cartridge 10. The seat 206 may comprise the same resin material as the frame 50, and may be manufactured using injection-molding. The seat 206 may have a hollow shape opening in an attachment direction 224 along which the opener 200 is attached to the ink cartridge 10. The attachment direction 224 may be parallel to a direction in which the rod 88 extends from the valve member 87 of the air communication valve mechanism 80. The seat 206 may comprise an attachment portion 214 configured to be attached to and to contact the ink cartridge 10. The seat 206 also may comprise the two arms 218 and 219 extending from the attachment portion 214 in the attachment direction 224. The arms 218 and 219 are separated by a predetermined distance in the height direction of the seat 206. The arm 218 may be positioned at a position corresponding to the engaging claw 15 of the supporting member 115, and the arm 219 may be positioned at a position corresponding to the engaging claws 144 of the translucent portion 140.

Figure 14D:
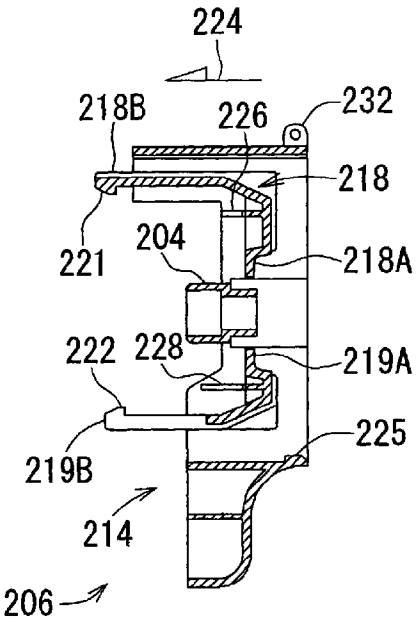
FIG. 14(D) is a cross-sectional view of the seat taken along a line XIVD-XIVD in FIG. 14(C).
Figure 14C:
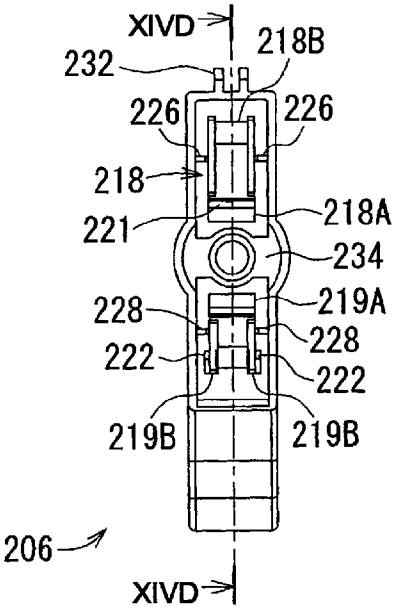
FIG. 14(C) is a front view of the seat of FIG. 14(A).
Figure 14A:
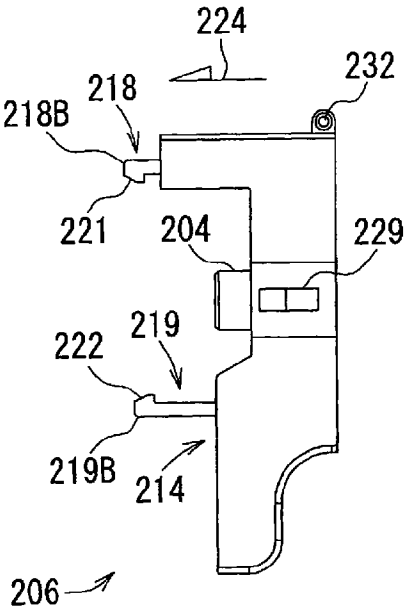
FIG. 14(A) is a side view of a seat of the opener of FIG. 11.
Figure 14B:
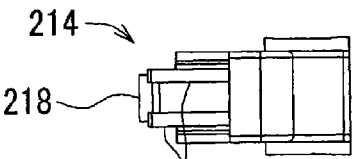
FIG. 14(B) is a bottom view of the seat of FIG. 14(A).
Figure 15A:
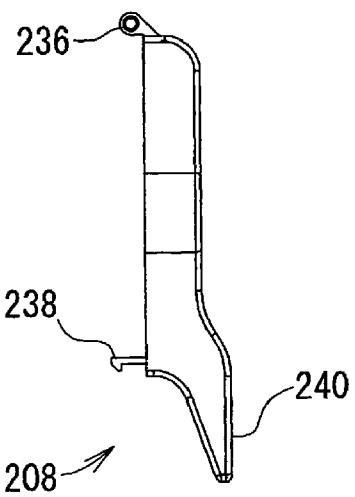
FIG. 15(A) is a side view of a cover of the opener of FIG. 11.
Figure 15B:
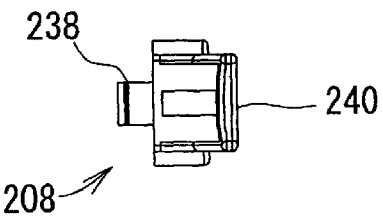
FIG. 15(B) is a bottom view of the cover of FIG. 15(A).
Figure 15C:
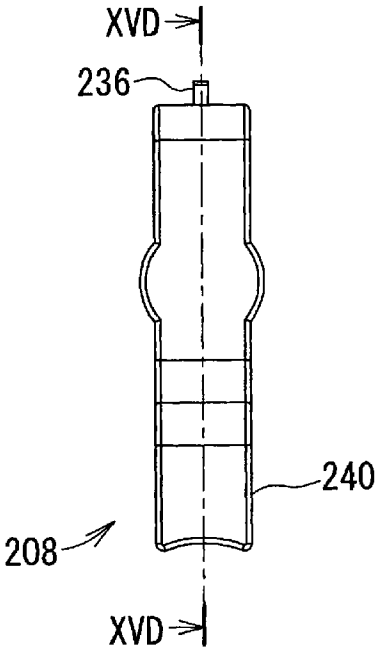
FIG. 15(C) is a front view of the cover of FIG. 15(A).
Figure 15D:
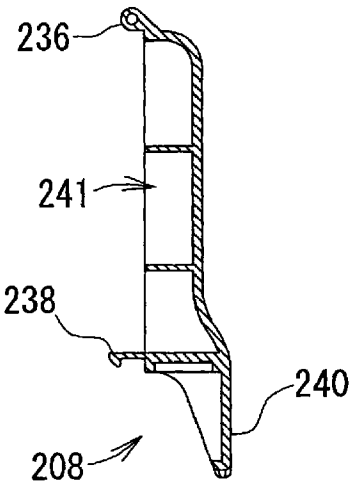
FIG. 15(D) is a cross-sectional view of the cover taken along a line XVD-XVD in FIG. 15(C).

Referring to FIG. 14(D), the arm 218 may be substantially hook shaped. Supporting portions 226 may be positioned between a proximal end 218A and a distal end 218B of the arm 218. Referring to FIG. 14(C), the supporting portions 226 connect the inner wall surface of the seat 206 and the arm 218, such that the arm 218 is supported by the supporting portions 226 in the interior of the seat 206. Because the arm 218 is supported in this manner, when no external force is applied to the proximal end 218A of the arm 218, the arm 218 is in an engaging position, as indicated by a solid line in FIG. 18, in which the arm 218 is engageable with the container body 20. Nevertheless, when an external force is applied to the proximal end 218A of the arm 218 in the attachment direction 224, the arm 218 moves, and the distal end 218B is retracted outward i.e. upward in FIG. 14(D), such that the arm 218 moves to a releasing position, as indicated by a broken line in FIG. 18, in which the arm 218 is disengaged from the container body 20.

Referring to FIG. 14(D), the arm 219 may be substantially hook shaped. The arm 219 may be bifurcated from a proximal end 219A to a pair of distal ends 219B, such that the arm 219 is separated into two branches towards the distal ends 219B. The positions of the two bifurcated distal ends 219B correspond to the two engaging claws 144 of the translucent portion 140, respectively. Supporting portions 228 may be positioned between the proximal end 219A and the distal ends 219B of the arm 219. Referring to FIG. 14(C), the supporting portions 228 connect the inner wall surface of the seat 206 with the arm 219, such that the arm 219 is supported by the supporting portions 228 in the interior of the seat 206. Because the arm 219 is supported in this manner, when no external force is applied to the proximal end 219A of the arm 219, the arm 219 is in an engaging position, as indicated by a solid line in FIG. 18, in which the arm 219 is engageable with the container body 20. Nevertheless, when an external force is applied to the proximal end 219A of the arm in the attachment direction 224, the arm 219 moves, and the distal ends 219B retract outward, i.e., downward in FIG. 14(D), such that the arm 219 moves to a releasing position, as indicated by a broken line in FIG. 18, in which the arm 219 is disengaged from the container body 20.

Figure 12:
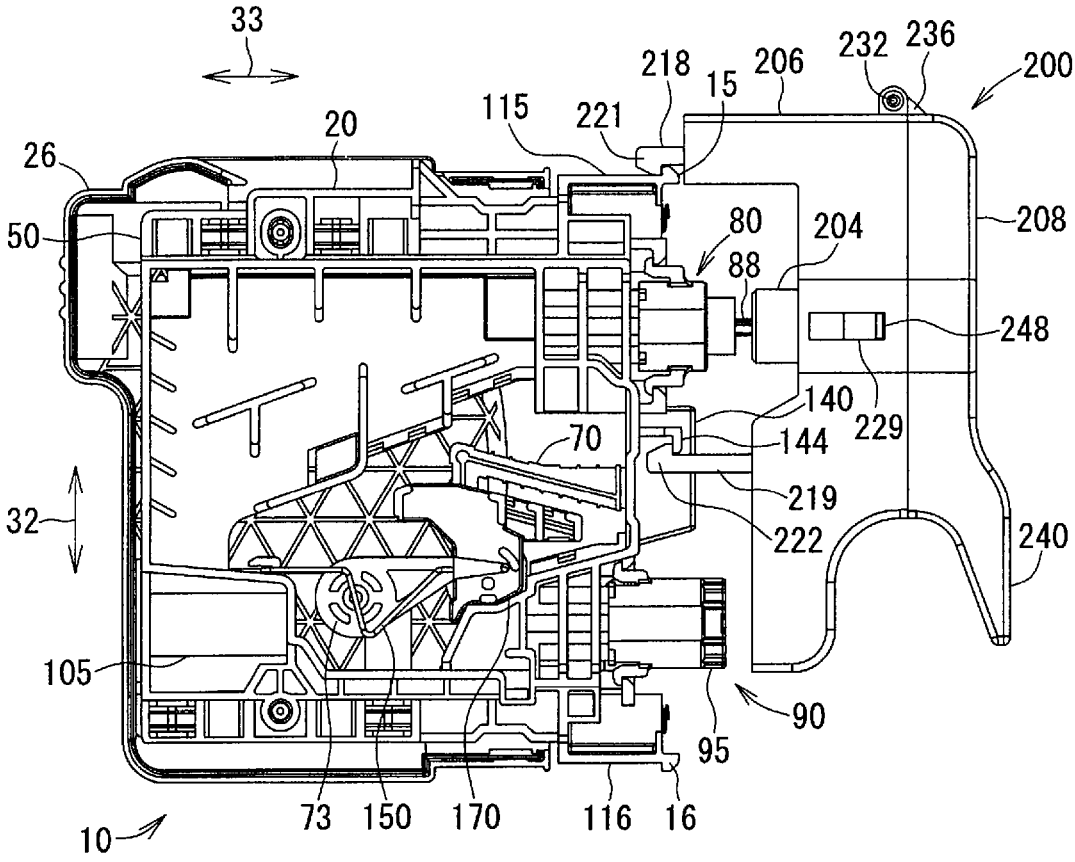
FIG. 12 is a side view of the ink cartridge assembly of FIG. 11, in which a housing and the movable member are omitted.

A hook-shaped engaging claw 221 may be formed on the distal end 218B of the arm 218, and the engaging claw 221 may be configured to engage the engaging claw 15 of the supporting member 115. Hook-shaped engaging claws 222 are formed on the distal ends 219B of the arm 219, respectively, and the engaging claws 222 are configured to engage the engaging claws 144 of the translucent portion 140, respectively. Referring to FIGS. 11 and 12, the seat 206 may be attached to the container body 20 by the engagement between the engaging claw 221 and the engaging claw 15 and the engagement between the engaging claws 222 and the engaging claws 144, respectively.

The attachment portion 214 may comprise a substantially cylindrical guide 204. The guide 204 may be positioned at a position corresponding to the opening 110 of the slider 27. When the seat 206 is attached to the ink cartridge 10, the guide 204 is inserted into the opening 110. The guide 204 has an inner hole (not numbered) formed therethrough, and a rod 244 of the operation member 210 is configured to be inserted into the inner hole of the guide 204.

A bearing 232 may be formed through the seat 206. The cover 208 may be attached to the seat 206, and may be configured to be pivotable about the shaft 212 which is inserted into the bearing 232 and a bearing 236 of the cover 208.

Referring to FIG. 14(C), a storage section 234 may be formed in the interior of the seat 206. The storage section 234 may be configured to store the operation member 210 and to slidably support the operation member 210 therein. The storage section 234 may be defined by a side wall of the seat 206 having a shape corresponding to the shape of the operation member 210.

Figure 13:
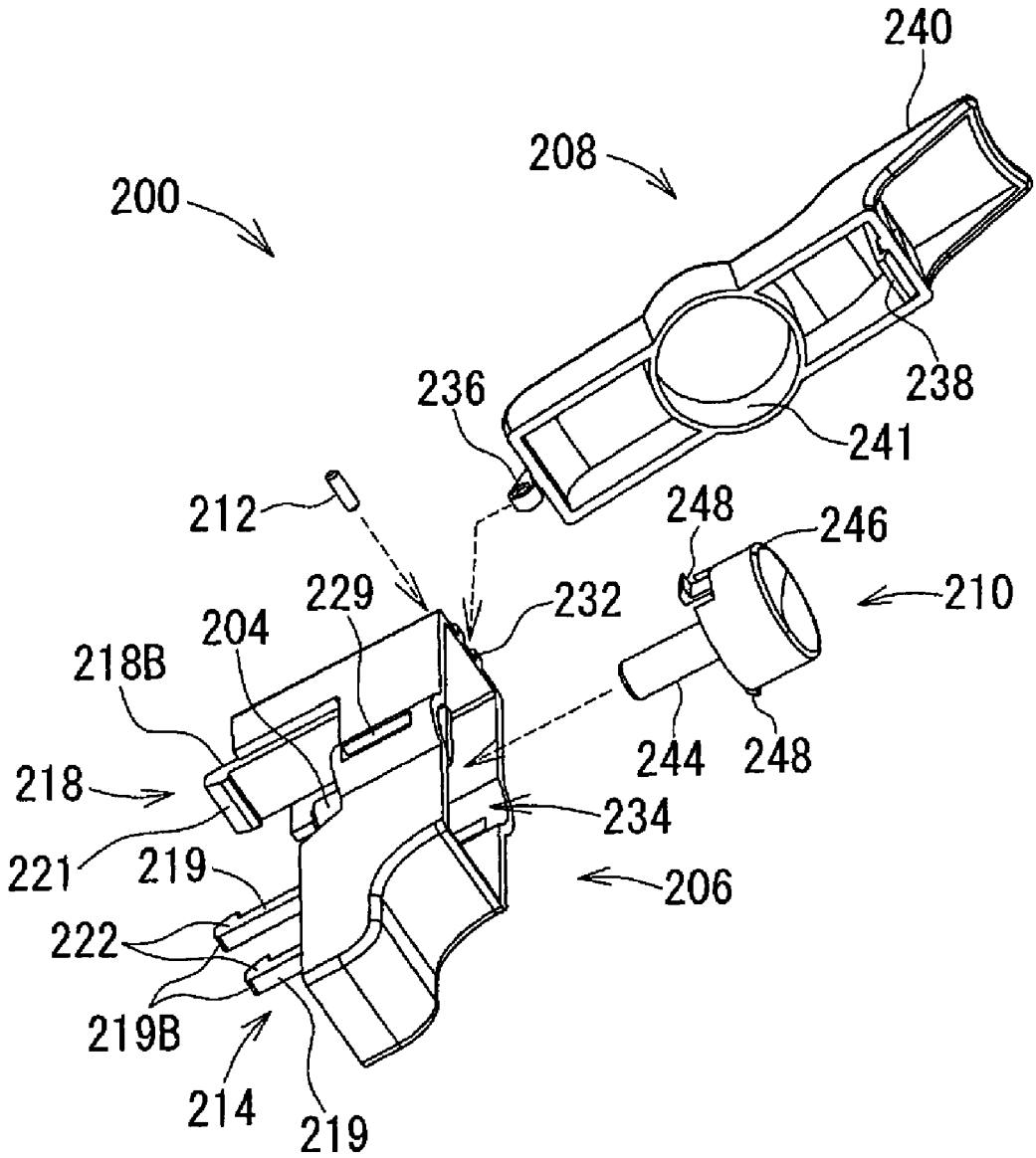
FIG. 13 is an exploded, perspective view of the opener of FIG. 11.

Referring to FIGS. 13 and 15, the cover 208 may comprise an engaging claw 238. When the cover 208 is moved to be positioned onto the seat 206, the engaging claw 238 engages a catch 225 positioned on the seat 206. When a lever portion 240 positioned at the end of the cover 208 receives a force, the lever portion 240 moves to disengage the engaging claw 238 from the catch 225.

The cover 208 may comprise a storage section 241 configured to receive, e.g., store, a pressing portion 246 of the operation member 210 therein. The storage section 241 may be configured to store the pressing portion 246 therein at least when the cover 200 is closed with respect to the seat 206.

Figure 16B:
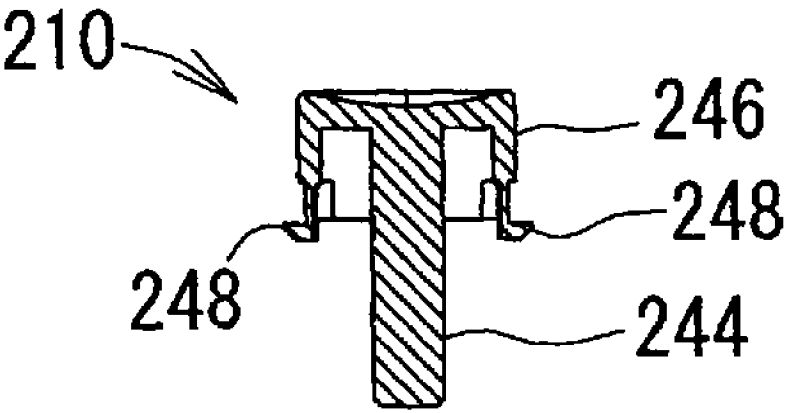
FIG. 16(B) is a cross-sectional view of the operation member taken along a line XVIB-XVIB in FIG. 16(A).
Figure 16A:
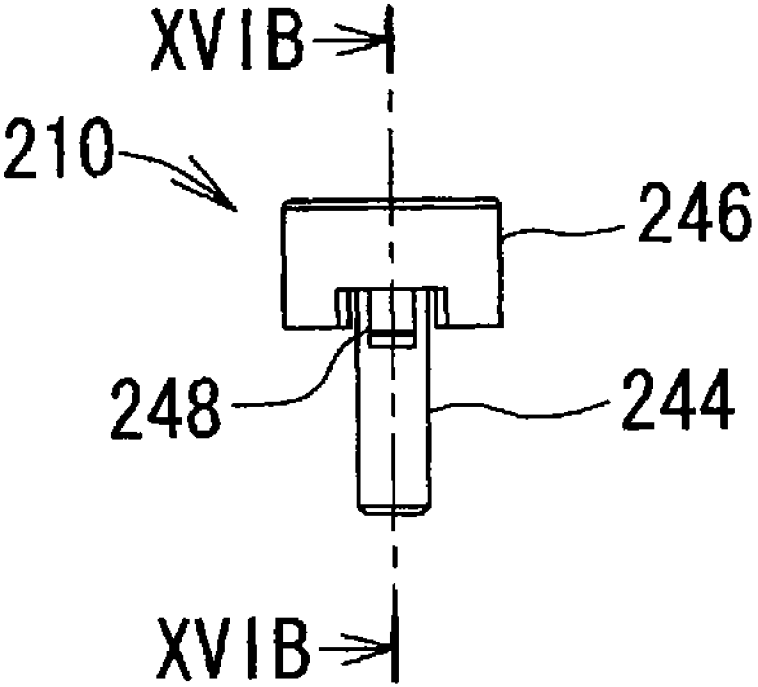
FIG. 16(A) is a side view of an operation member of the opener of FIG. 11.

Referring to FIGS. 13 and 16, the operation member 210 may be configured to be stored in the storage section 234 of the seat 206. The operation member 210 may have a mushroom shape, and may comprise the rod 244 and the pressing portion 246.

The rod 244 may have a cylindrical shape. The diameter of the rod 244 may be less than the diameter of the inner hole of the guide 204, and therefore, the rod 244 may be inserted into the inner hole of the guide 204. The pressing portion 246 is connected to an end of the rod 244. The pressing portion 246 may comprise two engaging claws 248.

Referring to FIG. 13, a method of assembling the opener 200 is described. In this exemplary method, the bearing 232 of the seat 206 and the bearing 236 of the cover 208 may be aligned, and then the shaft 212 may be inserted into the bearings 232 and 236. Subsequently, the operation member 210 may be stored in the storage section 234. When the operation member 210 is stored in the storage section 234, the rod 244 is inserted into the inner hole of the guide 204. Then, the engaging claws 248 may be fitted into elongated holes 229 formed through the side wall of the seat 206.

The engaging portion of the engaging claws 248, which engage the elongated holes 229, respectively, may have a surface area which is less than the surface area of the elongated holes 229 in the elongated direction of the elongated holes 229, e.g., a width of the engaging portion of the elongating claws 248 may be less than a diameter of the elongated holes 229. The engaging claws 248 are configured to slide within the elongated holes 229 between one end of the elongated holes 229 and the other end of the elongated holes 229. More specifically, the operation member 210 may be configured to move between a projected position in which the pressing portion 246 projects from the seat 206, and a retracted position in which the pressing portion 246 is retracted into the seat 206. When the opener 1200 is attached to the ink cartridge 10, and the operation member 210 is in the projected position, the operation member 210 is separated from the air communication valve mechanism 80. Nevertheless, when the operation member 210 moves from the projected position to the retracted position, the rod 244 contacts and pushes the valve member 87 of the air communication valve mechanism 80 to open the opening 81. After the operation member 210 is stored in the storage section 234, the cover 208 may be rotated towards the seat 206, such that the claw 238 of the cover 208 engages the catch 225 of the seat 206, which completes the method of assembling.

Figure 17:
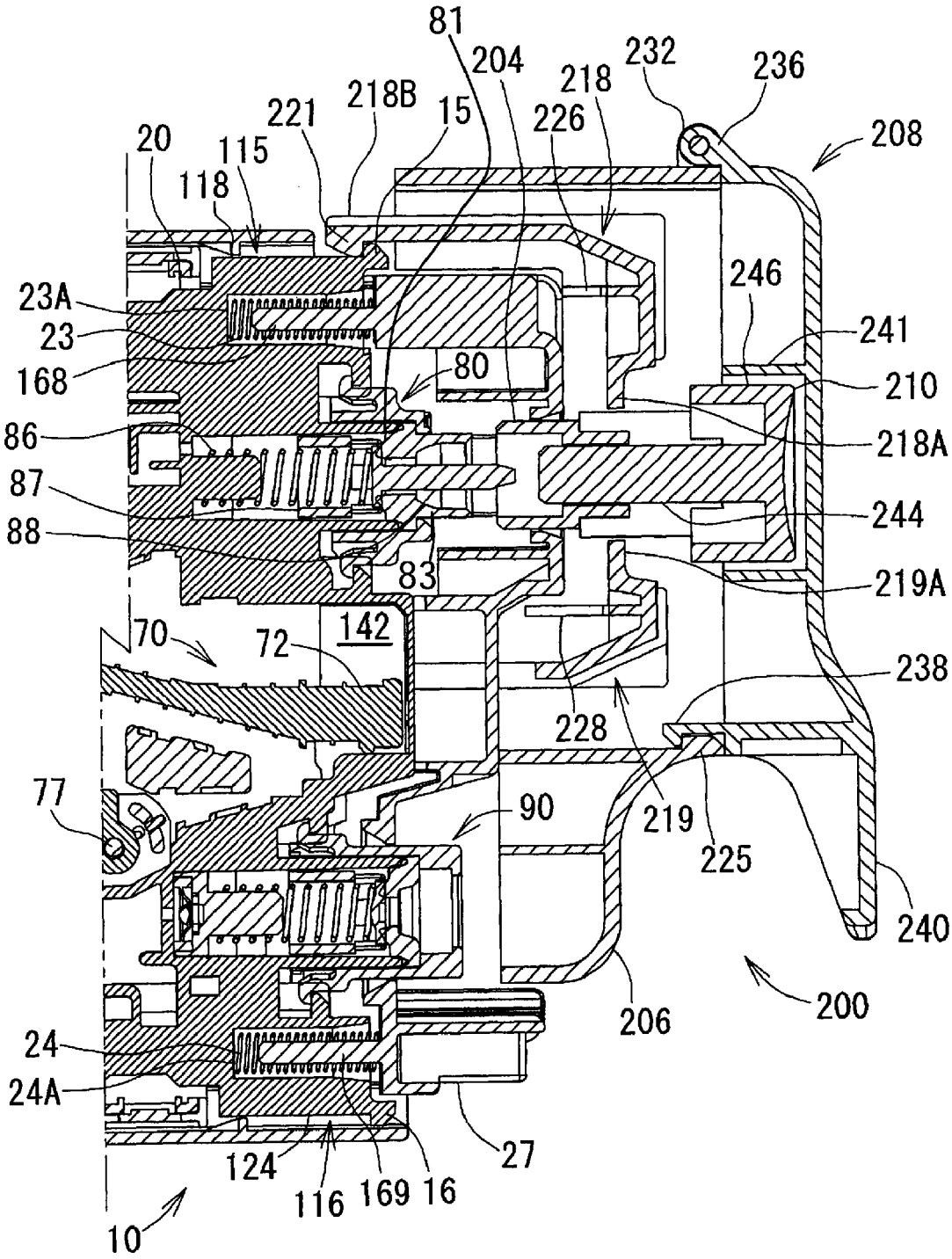
FIG. 17 is a partial, cross-sectional view of the ink cartridge assembly of FIG. 11.

Referring to FIG. 17, a method of attaching the opener 200 to the ink cartridge 10 is described. After ink is introduced into the ink chamber 100 and the pressure in the ink chamber 100 is reduced to be less than the atmospheric pressure, a force may be applied to the slider 27 to position the slider 27 in the second position, and the opener 200 then may be attached to the ink cartridge 10. For example, the attachment portion 214 of the opener 200 may be aligned with the front wall 161 of the slider 27, and the guide 204 may be positioned to face the opening 110. Then, when the opener 200 moves in a direction perpendicular to the front wall 161, the guide 204 may be inserted into the opening 110. Subsequently, when a further force is applied to the opener 200, the engaging claw 221 of the arm 218 may contact the engaging claw 15. When this occurs, the arm 218 may be resiliently deformed, and the engaging claw 221 may move over the engaging claw 15 and engage the engaging claw 15. Similarly, the engaging claws 222 of the arm 219 may contact the engaging claws 144, the arm 219 may be resiliently deformed, and the engaging claws 222 may move over the engaging claws 144, such that the engaging claw 222 engage the engaging claws 144. Accordingly, the opener 200 may engage the container body 20 to attach to the ink cartridge 10.

The air communication valve mechanism 80 is covered by the opener 200 and is protected by the opener 200 when the opener 200 is attached to the ink cartridge 10. Moreover, the slider 27 is retained at the second position against the biasing force of the coils springs 23 and 24.

Figure 18:
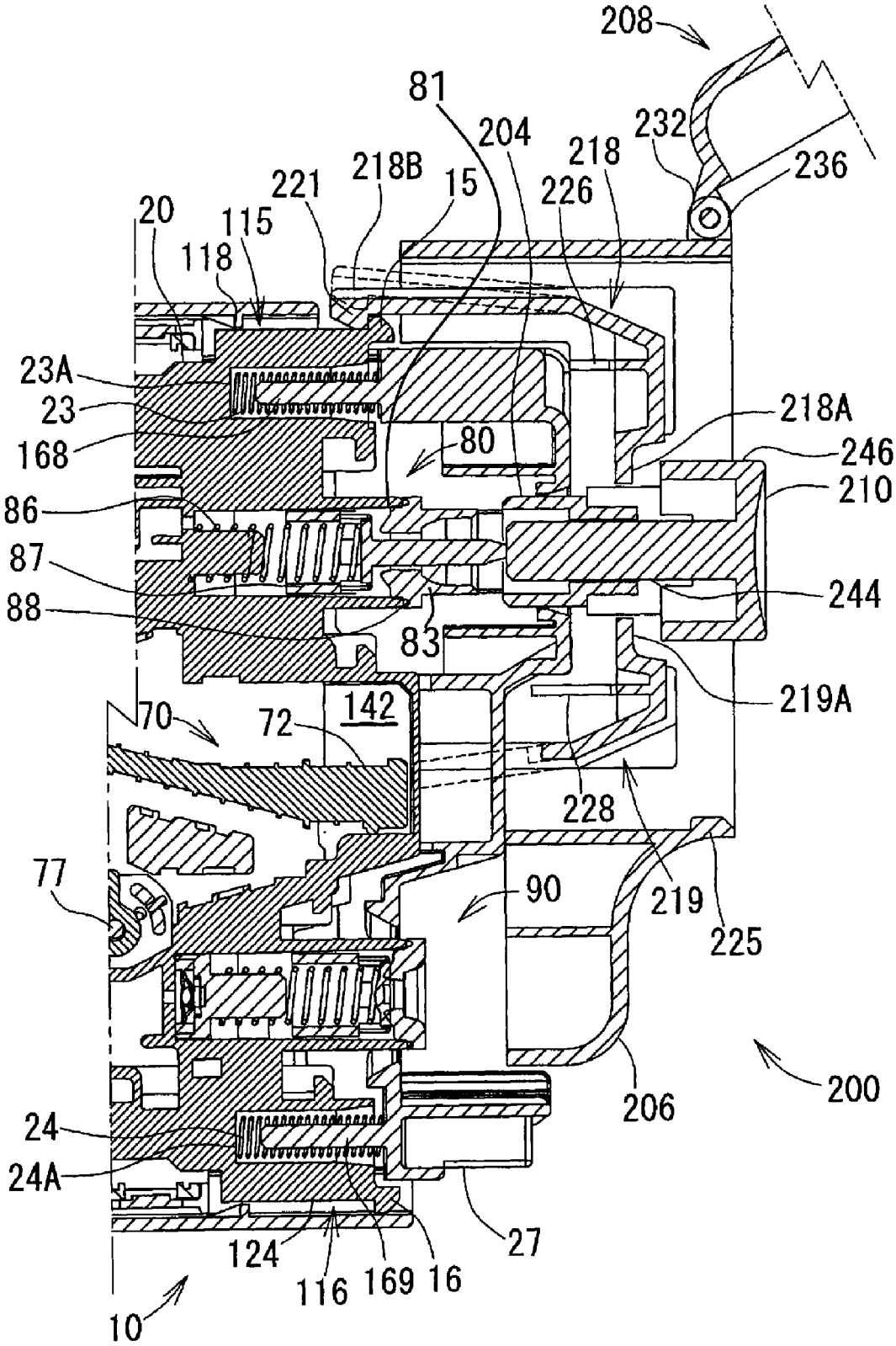
FIG. 18 is a partial, cross-sectional view of the ink cartridge assembly of FIG. 11, in which the operation member is pressed.
Figure 19:
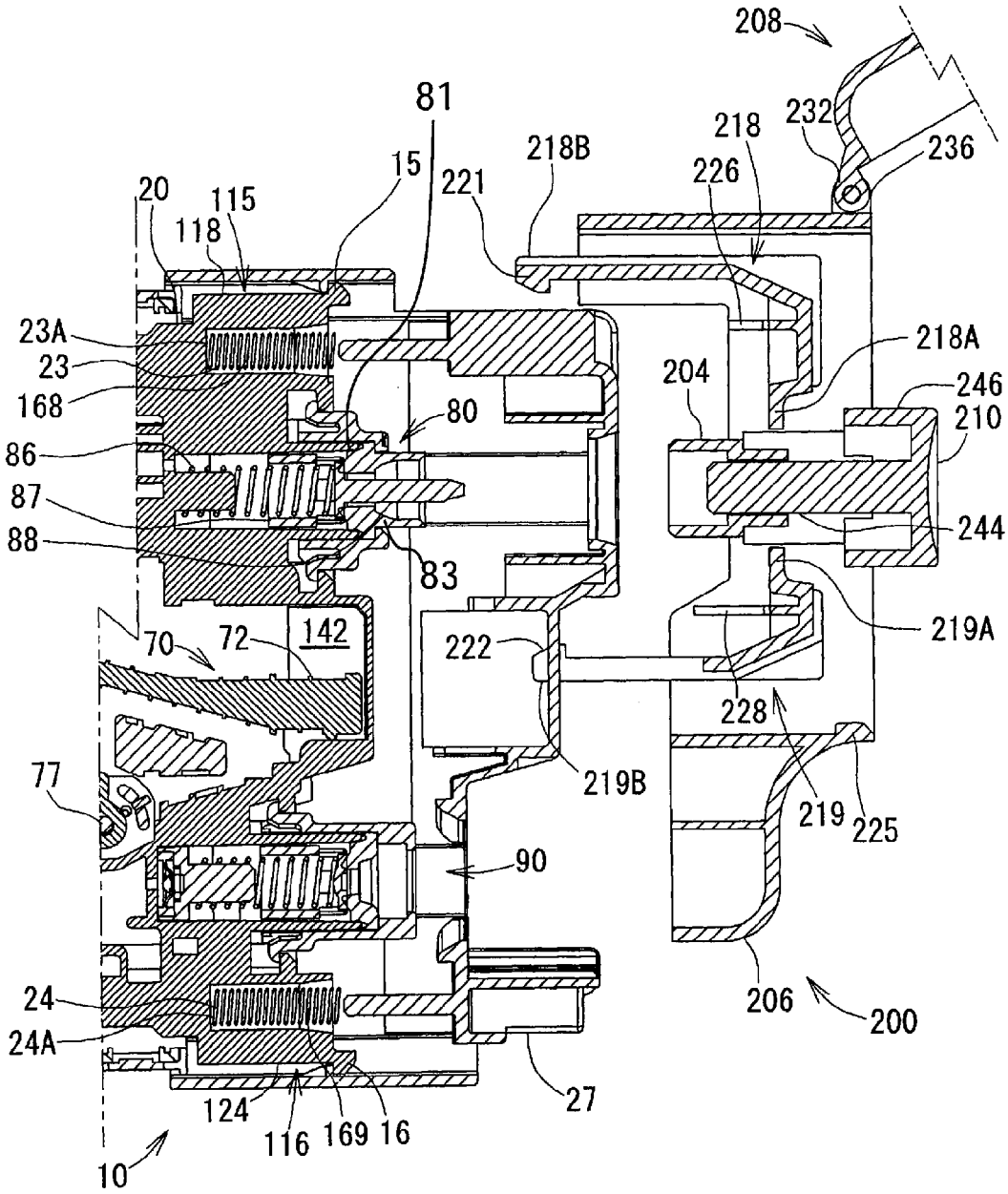
FIG. 19 is a partial, cross-sectional view of the ink cartridge assembly of FIG. 11, in which the opener is removed from the ink cartridge.
Figure 20:
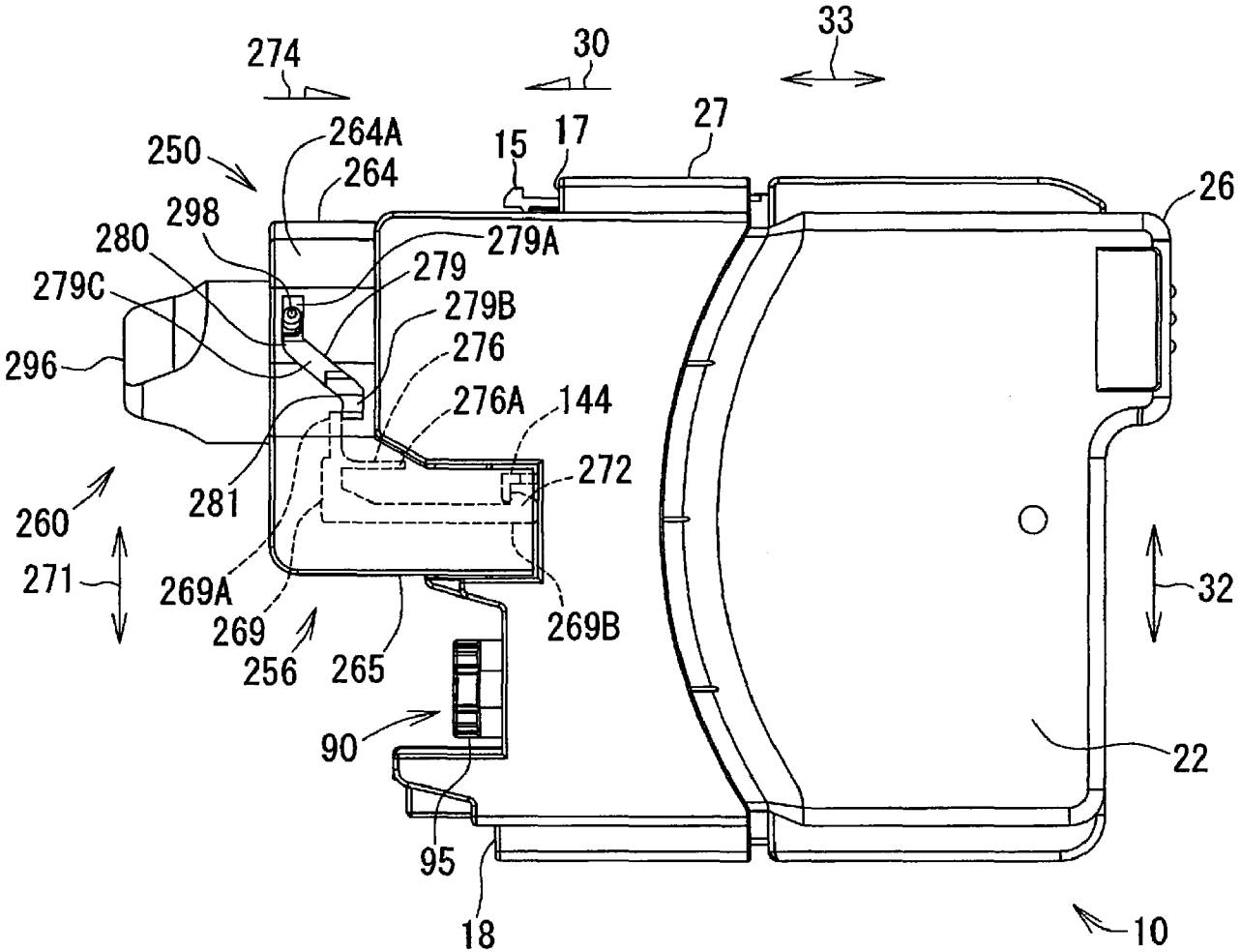
FIG. 20 is a side view of an ink cartridge assembly comprising the ink cartridge of FIGS. 1(A) and 1(B) and an opener, according to another embodiment of the present invention.
Figure 21:
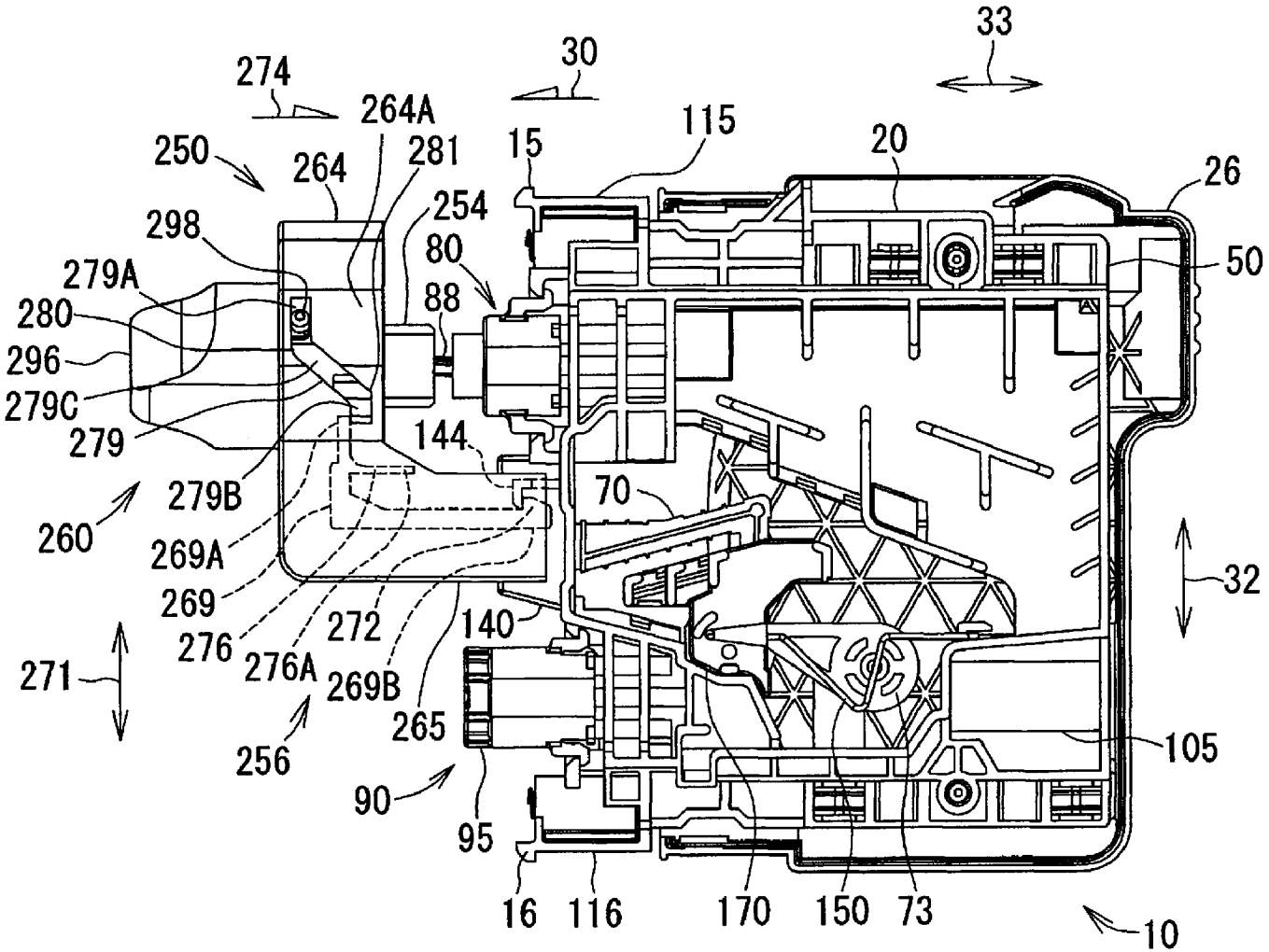
FIG. 21 is a side view of the ink cartridge assembly of FIG. 20, in which the housing and the movable member are omitted.
Figure 22B:
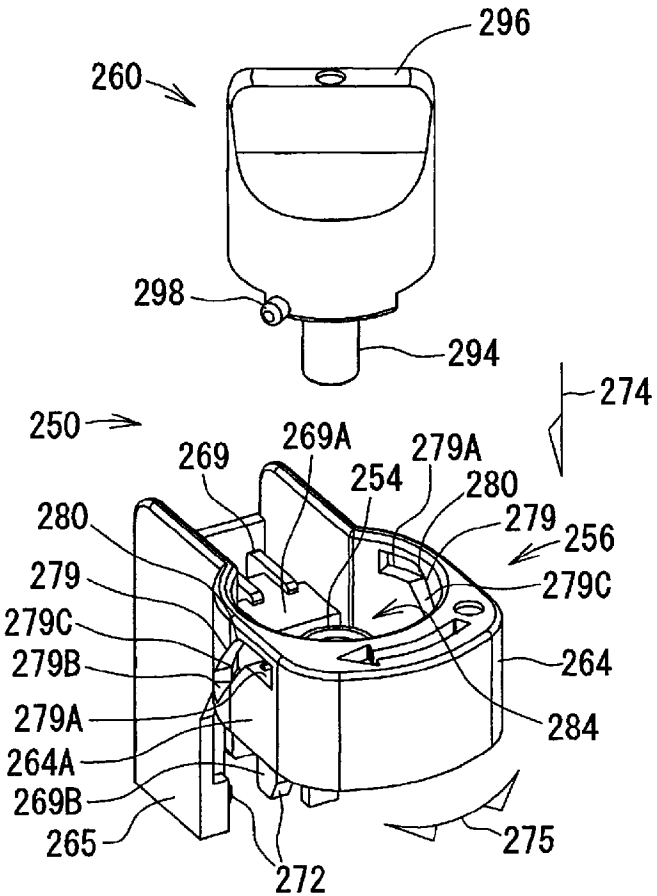
FIG. 22 is an exploded, perspective view of the opener of FIG. 20.
Figure 22A:
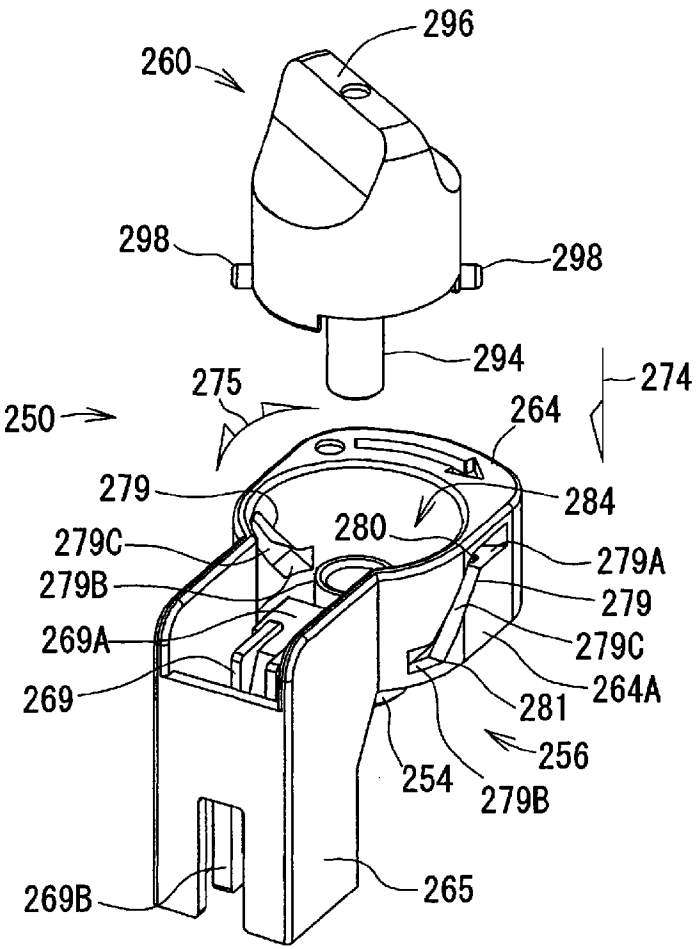

Referring to FIGS. 17-19, a method of removing the opener 200 from the ink cartridge 10 is described. A force may be applied to the lever portion 240 of the cover 208 to release the engagement between the cover 208 and the seat 206. Subsequently, as shown in FIG. 18, the cover 208 may be rotated to expose the pressing portion 246 of the operation member 210. When a force is applied to the pressing portion 246 toward the container body 20, the distal end of the rod 244 applies a force to the rod 88 extending from the valve member 87 to push the rod 88 toward the ink chamber 100. The valve member 87 then moves from the closed position in which the valve member 87 closes the opening 81 to the open position in which the valve member 87 opens the opening 81 against a biasing force of the spring 86. This allows the ink chamber 100 of the container body 20 to communicate with the atmosphere, such that the pressure in the ink chamber 100 is equalized with the atmospheric pressure.

When a further force is applied to the pressing portion 246, the pressing portion 246 contacts the proximal end 218A of the arm 218 and the proximal end 219A of the arm 219, respectively. When this occurs, the arm 218 may flex due to a pressing force applied to the proximal end 218A, the distal end 218B retracts outward, e.g., upward in FIG. 18, and the arm 218 moves to the releasing position, as indicated by the broken line in FIG. 18, which releases the engagement of the engaging claws 221 and 15. Similarly, the arm 219 may flex due to a pressing force applied to the proximal end 219A, which releases the engagement of the engaging claws 222 and 144. Subsequently, the opener 200 may be removed from the ink cartridge 10 by pulling the opener 200. As such, when engaging claws 221 and 222 engage engaging claws 15 and 144, respectively, the opener 200 may cover the opening 81 and the air communication valve mechanism 80, and when a force is applied to the operation member 210 to move the operation member 210 toward the container body 20, the operation member 210 may apply a particular force to the valve member 87 to move the valve member 87 away from the opening 81 toward the ink chamber 100, and the operation member 210 also may disengage engaging claws 221 and 222 from the engaging claws 15 and 144, respectively.

In this manner, by operating the pressing portion 246 of the operation member 210, the opening 81 may be opened at substantially the same time that the engagement between the opener 200 and the ink container 20 is released. Therefore, the opening 81 reliably may be opened before mounting the ink cartridge 10 to a recording apparatus. Consequently, when the ink cartridge 10 is mounted to a recording apparatus, backflow of ink from a recording head to the ink chamber 100 is prevented.

In another embodiment of the present invention, the air communication valve mechanism 80 may be replaced by an adhesive member, e.g., a vinyl adhesive tape or film, which is attached to the container body 20 to cover and close the opening 81. The pressure in the ink chamber may be equalized with the atmospheric pressure by the rod 244 puncturing at least one portion of the adhesive member and pushing the at least one portion of the adhesive member away from the opening 81 and toward the ink chamber 100.

Referring to FIGS. 20-25(C), an ink cartridge assembly according to another embodiment of the present invention is depicted. The ink cartridge assembly of this embodiment comprises the ink cartridge 10, and an opener 250 which is removably attached to the ink cartridge 10. The opener 250 may be configured to cover the air communication valve mechanism 80 and the translucent portion 140 when the opener 250 is attached to the ink cartridge 10, and also may be configured to cause the air communication valve mechanism 80 to open the opening 81. The opener 250 may comprise a seat 256 and an operation member 260.

The seat 256 may be configured to be directly attached to the ink cartridge 10. The seat 256 may be configured to be attached to the ink cartridge 10 along an attachment direction 274. The attachment direction 274 may be parallel to a direction in which the rod 88 extends from the valve member 87 of the air communication valve mechanism 80. The operation member 260 may be configured to be movable relative to the seat 256 in a direction which is parallel to the attachment direction 274. The attachment direction 274 may be substantially perpendicular to the front face 41 of the container body 20. The seat 256 may comprise the same resin material as the frame 50, and may be manufactured using injection-molding. The seat 256 may have an L-shape, and may comprise an attachment portion 264 configured to be attached to a portion of the slider 27 adjacent to the opening 110, and a cover portion 265 configured to cover the translucent portion 140.

The seat 256 may comprise an arm 269 extending from a proximal end 269A, which is positioned adjacent to the attachment portion 264, in a direction substantially perpendicular to the attachment direction 274, and is bent to extend along the attachment direction 274 toward the ink cartridge 10 within the cover portion 265. The arm 269 may be bifurcated from the proximal end 269A to a pair of distal ends 269B, such that the arm 269 is separated into two branches towards the distal ends 269B. The arm 269 may be configured to be positioned, such that two bifurcated distal ends 219B engage the two engaging claws 144 of the translucent portion 140, respectively.

Hook-shaped engaging claws 272 may be formed on the distal ends 269B of the arm 269, respectively, and the engaging claws 272 are configured to engage the engaging claws 144 of the translucent portion 140, respectively. The seat 256 may be attached to the container body 20 by the engagement between the engaging claws 272 and the engaging claws 144, respectively.

A supporting portion 276 may be positioned between the proximal end 269A and the distal ends 269B of the arm 269. The supporting portion 276 may have a plate shape extending from the arm 269 to an end 276A of the supporting portion 276 in a direction parallel to the attachment direction 274. The end 276A of the supporting portion 276 may be connected to inner surfaces of the cover portion 265 in the width direction 31, such that the arm 269 is supported by the supporting portion 276 within the cover portion 265.

When no external force is applied to the proximal end 269A of the arm 269, the arm 269 may be in an engaging position, as shown in FIGS. 20, 21, 23(C) and 24(C), in which the arm 269 is engageable with the container body 20. When an external force is applied to the proximal end 269A of the arm 269 in the attachment direction 274, the arm 269 may flex and rotate around the end 276A of the supporting portion 276, such that the distal ends 269B retract outward, i.e., downward in FIG. 25(C), to a releasing position in which the arm 269 is disengaged from the container body 20.

The attachment portion 264 may comprise a substantially cylindrical guide 254. The guide 254 may be positioned at a position corresponding to the opening 110 of the slider 27. When the seat 256 is attached to the ink cartridge 10, the guide 254 may be inserted into the opening 110. The guide 254 has a cylindrical inner hole (not numbered) formed therethrough, and a rod 294 of the operation member 260 may be configured to be inserted into the inner hole of the guide 264.

A storage section 284 may be formed in the interior of the attachment portion 264. The storage section 284 may be configured to store the operation member 260 and to slidably support the operation member 260 therein. The storage section 284 may be defined by an inner surface of a side wall 264A of the attachment portion 264, and the storage section 284 may have a shape corresponding to the shape of the operation member 260.

The side wall 264A of the attachment portion 264 may have at least one slit, e.g., two slits 279, formed therethrough, and the operation member 260 may comprise at lest one pin, e.g., two pins 298, configured to be positioned within the two slits 279, respectively. Each slit 279 may comprise an first slit portion 279A, a second slit portion 279B, and an inclined slit portion 279C connected to the first slit portion 279A at a first end of the inclined slit portion 279C and connected to the second slit portion 279B at a second end of the inclined slit portion 279C opposite the first end of the inclined slit portion 279C. The first slit portion 279A extends from the first end of the inclined slit portion 279C in a direction perpendicular to the attachment direction 274, and the second slit portion 279B extends from the second end of the inclined slit portion 279C in the direction perpendicular to the attachment direction 274. The inclined slit portion 279C extends from the first end of the inclined slit portion 279C to the second end of the inclined slit portion 279C in a direction which is inclined with respect to the attachment direction 274.

The operation member 260 may be configured to stored in the storage section 284 of the attachment portion 264. The operation member 260 may have substantially a cylindrical shape, and may comprise a grip portion 296 and a rod 294 extending from the grip portion 296. The cylindrical inner hole of the guide 254 may have a central axis extending in a direction parallel to the attachment direction 274. The operation member 260 may be configured to rotate in the interior of the storage section 284 in a direction 275 about the central axis of the guide 254. The operation member 260 also may be configured to move in the interior of the storage section 284 in the attachment direction 274 when the operation member 260 rotates.

The rod 294 may have a cylindrical shape, and the diameter of the rod 294 may be less than the diameter of the inner hole of the guide 254, such that the rod 294 is inserted into the inner hole of the guide 254.

The grip portion 296 may comprise a peripheral wall comprising the two pins 298. The two pins 298 may extend from the peripheral wall of the grip portion 296 in the normal direction of the peripheral wall of the grip portion 296, i.e. in a direction perpendicular to the tangent to the peripheral wall of the grip portion 296. When the operation member 260 is stored in the storage section 284, the two pins 298 may be positioned within the two slits 279, respectively. When a user rotates the grip portion 296, the operation member 260 may rotate in the direction 275 and move in the attachment direction 274 while the pins 298 are guided by the slits 279, respectively.

When the opener 250 is assembled, the rod 294 may be inserted into the inner hole of the guide 254. Subsequently, the operation member 260 may be pushed into the storage section 284, such that the side wall 264A of the attachment portion 264 is resiliently deformed to the outside by the operation member 260. When the operation member 260 is further pushed in the attachment portion 264, the pins 298 may move into the slits 279, respectively, which completes the assembly.

When the pins 298 are positioned within the first slit portions 279A or the second slit portions 279B, respectively, the operation member 260 may be prevented from moving relative to the seat 256 in the attachment direction 274 and a direction opposite to the attachment direction 274 because the pins 298 contact edges of the first slit portions 279A or second slit portions 279B, respectively.

When the grip portion 296 is rotated, the pins 298 may move from the first slit portions 279A or the second slit portions 279B to the inclined slit portions 279C, respectively. When an external force is applied in at least one of the attachment direction 274, a direction opposite to the attachment direction 274, and the direction 275, to the operation member 260 whose pins 298 are positioned within the inclined slit portions 279C, each pin 298 may move toward the first end of the inclined slit portion 279C or the second end of the inclined slit portion 279C along the inclined slit portion 279C, such that the operation member 260 rotates in the direction 275, and moves in the attachment direction 274 or the direction opposite to the attachment direction 274. In this embodiment, when the grip portion 296 is rotated in the clockwise direction 273 in FIGS. 23(A), 24(A), and 25(A), the operation member 260 rotates in the clockwise direction 273 and moves in the attachment direction 274. In contrast, when the grip portion 296 is rotated in the counterclockwise direction, the operation member 260 rotates in the counterclockwise direction and moves in a direction opposite to the attachment direction 274.

Figure 23C:
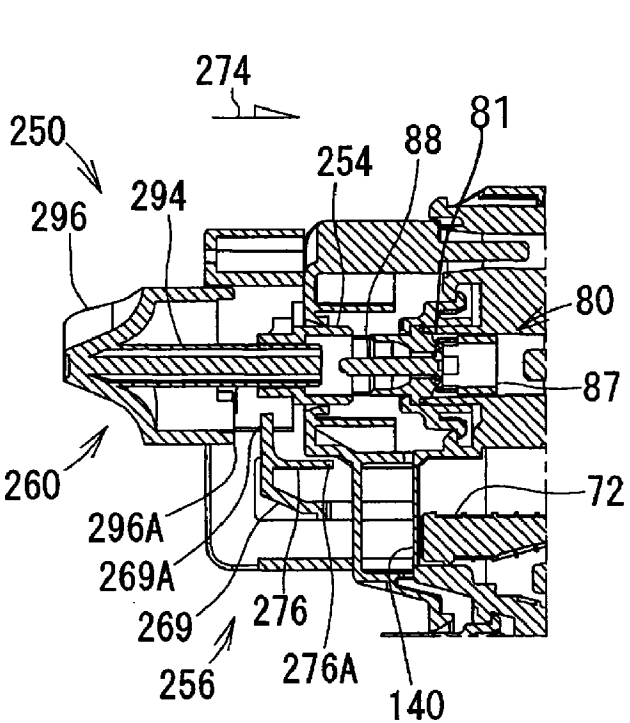
FIG. 23(C) is a cross-sectional view of the opener and the portion of the ink cartridge of FIG. 23(B).
Figure 23B:
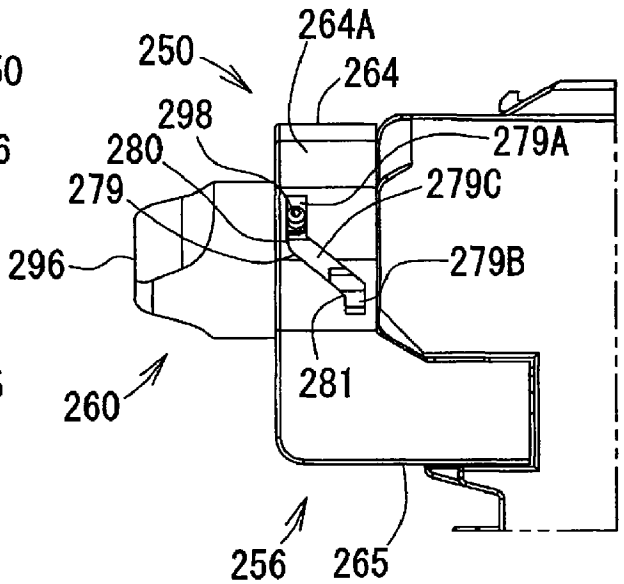
FIG. 23(B) is a side view of the opener and a portion of the ink cartridge of the ink cartridge assembly of FIG. 20, before a grip portion of the opener is rotated.
Figure 23A:
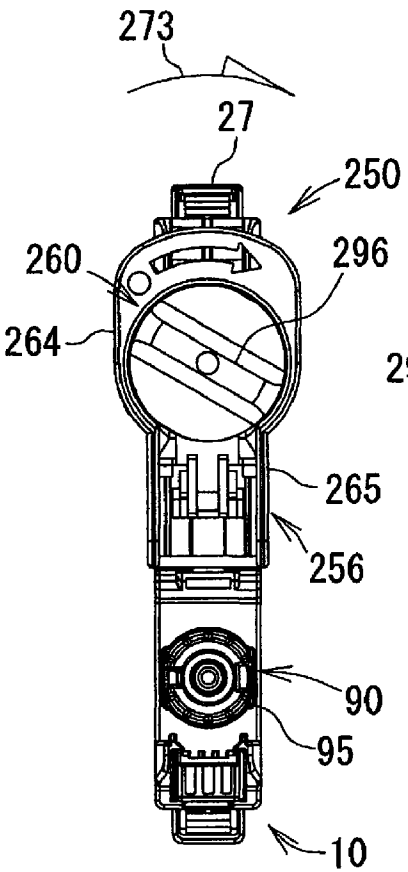
FIG. 23(A) is a front view of the ink cartridge assembly of FIG. 20, before a grip portion of the opener is rotated.
Figure 25C:
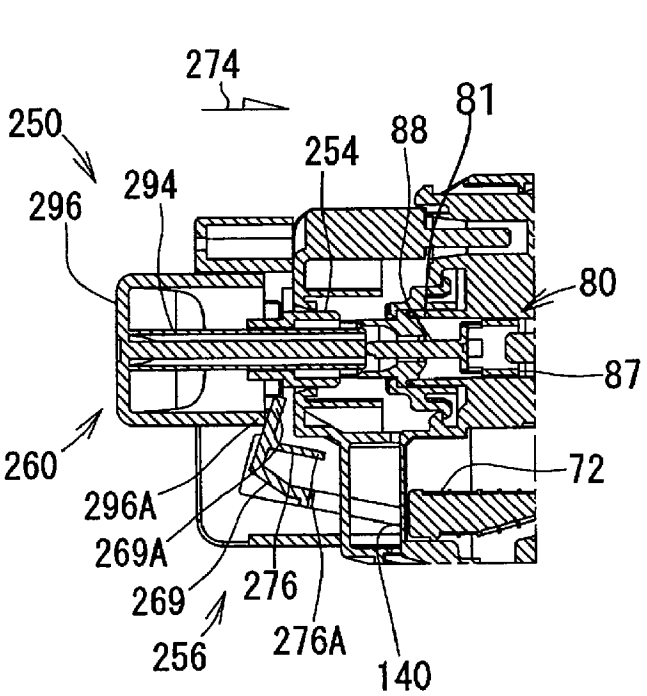
FIG. 25(C) is a cross-sectional view of the opener and the portion of the ink cartridge of FIG. 25(B).
Figure 25B:
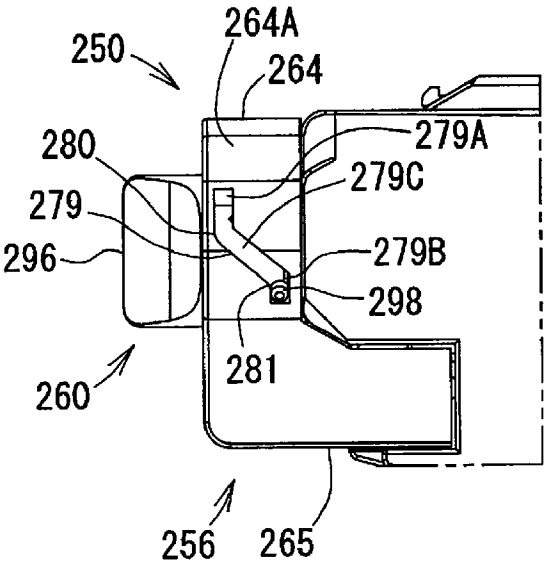
FIG. 25(B) is a side view of the opener and the portion of the ink cartridge assembly of FIG. 20, in which the grip portion of the opener is rotated to the end.
Figure 25A:
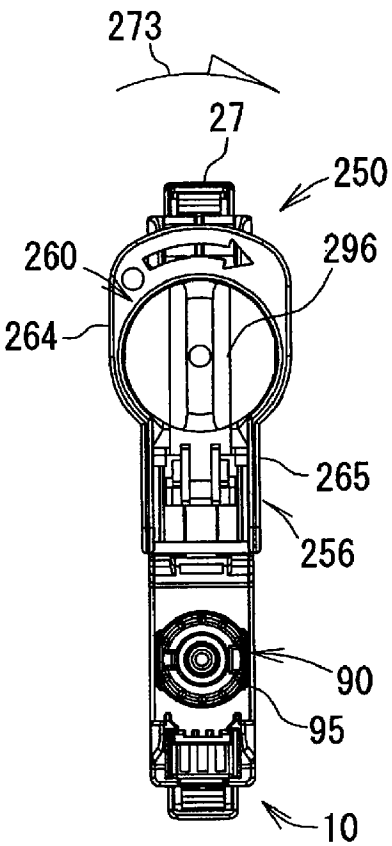
FIG. 25(A) is a front view of the ink cartridge assembly of FIG. 20, in which the grip portion of the opener is rotated to the end.

In this embodiment, when the opener 250 is attached to the ink cartridge 10, and the pins 298 are positioned within the first slit portions 279A, respectively, the operation member 260 is positioned in an unoperated position, in which the operation member 260 is positioned furthest from the front face 41 of the container body 20, such that the rod 294 is positioned furthest from the rod 88 of the valve member 87, as shown in FIGS. 23(A)-23(C). In contrast, when the pins 298 are positioned within the second slit portions 279B, respectively, the operation member 260 is positioned in an operated position, in which the operation member is positioned closest to the front face 41 of the container body 20, such that the rod 294 contacts and applies a force to the rod 88 of the valve member 87 to open the opening 81, as shown in FIGS. 25(A)-25(C).

Referring to FIGS. 23(A)-23(C), a method of attaching the opener 250 to the ink cartridge 10 is described. After ink is introduced into the ink chamber 100 and the pressure in the ink chamber 100 is reduced to be less than the atmospheric pressure, a force may be applied to the slider 27 to position the slider 27 in the second position, and then the opener 250 may be attached to the ink cartridge 10. For example, operation member 260 may be moved to be positioned in the unoperated position, and the attachment portion 264 then may be aligned to the front wall 161 of the slider 27, such that the guide 254 faces the opening 110. Subsequently, when the opener 250 moves in the attachment direction 274, which is a direction perpendicular to the front wall 161, the guide 254 may be inserted into the opening 110. When the opener 250 moves further, the cover portion 265 may cover the translucent portion 140, such that the engaging claws 272 contact the engaging claws 144, respectively. When this occurs, the arm 269 may be resiliently deformed, and the engaging claws 272 may move over the engaging claws 144, such that the engaging claws 272 engage the engaging claws 144, respectively. Accordingly, the opener 250 may engage the container body 20 to attach to the ink cartridge 10.

When the opener 250 is attached to the ink cartridge 10, the air communication valve mechanism 80 is covered and protected by the opener 250. Moreover, the slider 27 is retained at the second position against the biasing force of the coil springs 23 and 24. Because the operation member 260 is positioned in the unoperated position, the rod 294 of the operation member 260 does not contact the rod 88 of the valve member 87.

Referring to FIGS. 23(A)-25(C), a method of removing the opener 250 from the ink cartridge 10 is described. When the operation member 260 is positioned in the unoperated position, as shown in FIGS. 23(A)-23(C), the pins 298 may be positioned in the first slit portions 279A, respectively. Therefore, even when an external force is applied to the grip portion 296 in the attachment direction 274, the operation member 260 may not move. When the grip portion 296 is moved in the direction 273, the pins 298 may move from the first slit portions 279A to the inclined slit portions 279C, respectively. The operation member 260 may rotate in the direction 273 and move in the attachment direction 274 while the pins 298 are guided by the inclined slit portions 279C, respectively.

Figure 24C:
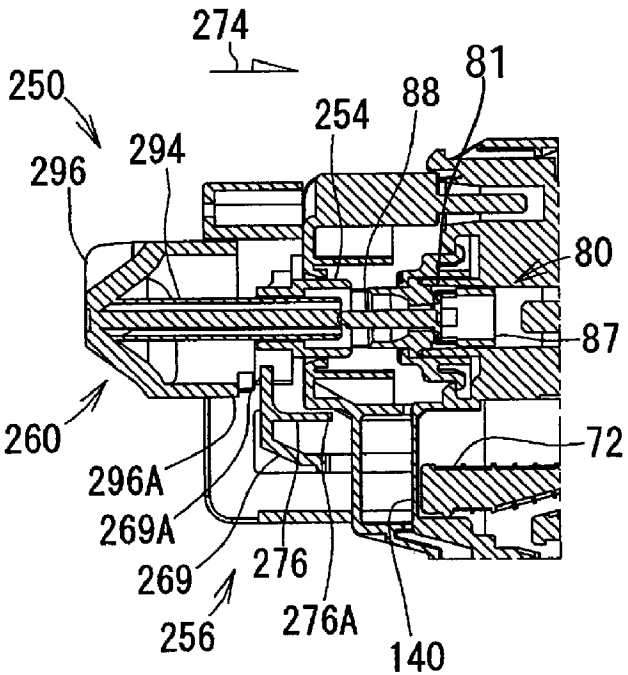
FIG. 24(C) is a cross-sectional view of the opener and the portion of the ink cartridge of FIG. 24(B).
Figure 24B:
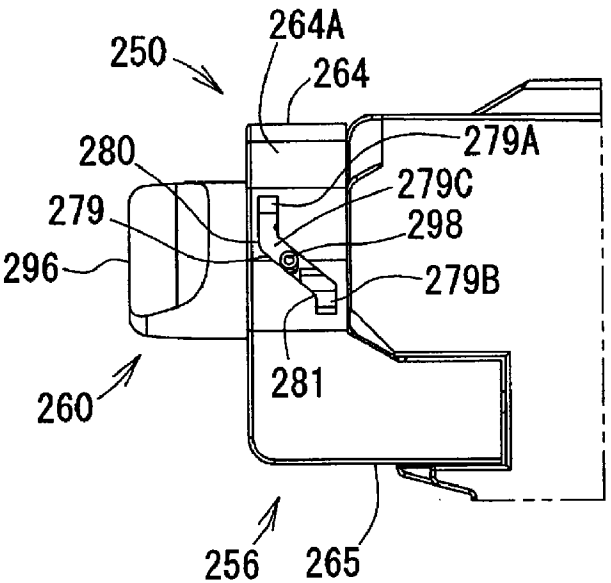
FIG. 24(B) is a side view of the opener and the portion of the ink cartridge of the ink cartridge assembly of FIG. 20, in which the grip portion of the opener is rotated to some extent.
Figure 24A:
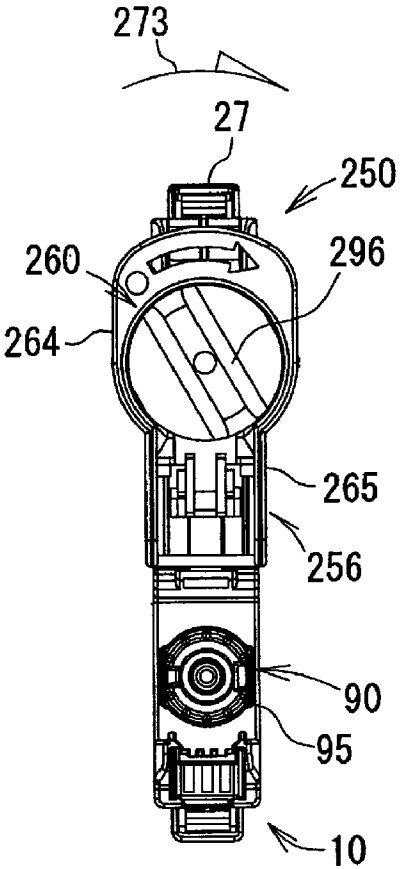
FIG. 24(A) is a front view of the ink cartridge assembly of FIG. 20, in which the grip portion of the opener is rotated to some extent.

When the operation member 260 moves in the attachment direction 274, the distal end of the rod 294 of the operation member 260 may contact the distal end of the rod 88 of the valve member 87, as shown in FIGS. 24(A)-24(C). When the operation member 260 moves further in the attachment direction 274, the rod 294 may apply a force to the rod 88 to push the rod 88 toward the ink chamber 100. The valve member 87 then moves from the closed position in which the valve member 87 closes the opening 81 to the open position in which the valve member 87 opens the opening 81 against a biasing force of the spring 86, as shown in FIGS. 25(A)-25(C). This allows the ink chamber 100 of the container body 20 to communicate with the atmosphere, such that the pressure in the ink chamber 100 is equalized with the atmospheric pressure.

When the operation member 260 moves further in the attachment direction 274, an end 296A of the grip portion 296 positioned adjacent to the proximal end 269A of the arm 269 may contact and apply a force to the proximal end 269A in the attachment direction 274. When this occurs, the force may cause the arm 269 to flex, and the distal ends 269B of the arm 269 retract outward, i.e., downward in FIG. 25(C), to the releasing position, as shown in FIG. 25(C), which releases the engagement of the engaging claws 144 and 272.

When the arm 269 is in the releasing position, the pins 298 may have been positioned within the second slit portions 279B, respectively. Subsequently, when the operation member 296 is pulled in the direction opposite to the attachment direction 274, the pins 298 may contact the edges of the second slit portions 279B, respectively, and therefore the opener 250 entirely may be removed from the ink cartridge 10.

As such, when engaging claws 272 engage engaging claws 144, respectively, the opener 250 may cover the opening 81 and the air communication valve mechanism 80, and when the operation member 260 moves toward the container body 20, the operation member 260 may apply a force to the valve member 87 to move the valve member 87 away from the opening 81 toward the ink chamber 100, and the operation member 260 also may disengage engaging claws 272 from the engaging claws 144, respectively.

In this manner, by rotating the grip portion 296 of the operation member 260, the opening 81 may be opened, and then the engagement between the opener 250 and the container body 20 may be released. Therefore, the one operation of rotating the grip portion 296 may lead to two operations of opening the opening 81, and the releasing the engagement. The opening 81 reliably may be opened before the ink cartridge 10 is mounted to a recording apparatus. Consequently, when the ink cartridge 10 is mounted to a recording apparatus, backflow of ink from a recording head to the ink chamber 100 is prevented.

When the opener 250 is attached to the ink cartridge 10, and the pins 298 are positioned in the first slit portions 279A, respectively, even if an external force is applied to the grip portion 296 of the operation member 260 in the attachment direction 274, the operation member 260 may not move. Therefore, the operation member 260 may be prevented from moving accidentally.

When the pins 298 are positioned in the second slit portions 279B, respectively, the opener 250 may be entirely removed from the ink cartridge 10 by pulling the grip portion 296 of the operation member 260. Therefore, the opener 250 readily may be removed from the ink cartridge 10.

In another embodiment, the first slit portions 279A may be omitted, or the second slit portions 279B may be omitted.

In another embodiment, the inclined slits 297C may not be inclined with respect to the attachment direction 274. The inclined slits 297C may extend parallel to the attachment direction 274.

In another embodiment, the side wall 264A of the attachment portion 264 may comprise pins 298 instead of having the slits 279 formed therethrough, and the peripheral wall of the grip portion 296 may have slits 279 formed therethrough configured to receive the pins 298, instead of comprising the pins 298.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

What is claimed is:

1. An ink cartridge assembly comprising:

an ink cartridge comprising:

a body defining an ink chamber therein, wherein the body has a particular face, and the particular face has a particular opening formed therethrough, wherein an interior of the ink chamber is configured to be in fluid communication with an exterior of the ink chamber via the particular opening; and a sealing member configured to close the particular opening; and a cover member configured to be attached to the ink cartridge and to cover the particular opening when attached thereto, the cover member comprising:

a first portion configured to engage the body and to attach the cover member to the ink cartridge when the first portion engages the body; and a second portion configured to move in a predetermined direction, to apply a particular force to the sealing member when moved in the predetermined direction, such that the sealing member moves in the predetermined direction toward the ink chamber to facilitate fluid communication between the interior of the ink chamber and the exterior of the ink chamber, and to disengage the first portion from the body when moved in the predetermined direction.

2. The ink cartridge assembly of claim 1, wherein the sealing member comprises an adhesive member, and the second portion is configured to puncture at least one portion of the adhesive member and to move the at least one portion of the adhesive member away from the particular opening and toward the ink chamber when the second portion is moved in the predetermined direction.

3. The ink cartridge assembly of claim 1, wherein the sealing member comprises a valve mechanism.

4. The ink cartridge assembly of claim 3, wherein the valve mechanism comprises:

a valve member; and an urging member, wherein the urging member is configured to apply a biasing force to the valve member to urge the valve member toward the particular opening, and wherein the second portion is configured to apply the particular force to the valve member to move the valve member away from the particular opening against the biasing force when the second portion is moved in the predetermined direction.

5. The ink cartridge assembly of claim 4, wherein the valve mechanism further comprises a rod extending from the valve member in the predetermined direction, and the second portion is configured to push the rod to apply the particular force to the valve member to move the valve member away from the particular opening when the second portion is moved in the predetermined direction.

6. The ink cartridge assembly of claim 1, wherein the ink cartridge further comprises:

a movable member configured to move with respect to the body between a first position and a second position, wherein a distance between the second position and the particular face is less than a distance between the first position and the particular face; and at least one resilient member coupled to the particular face and to the movable member, wherein the at least one resilient member is configured to apply a further force to the movable member to urge the movable member into the first position, wherein when the first portion engages the body the cover member is configured to position the movable member in the second position against the further force, and when the first portion is disengaged from the body the at least one resilient member positions the movable member in the second position.

7. The ink cartridge assembly of claim 1, wherein the second portion is configured to move relative to the first portion in the particular direction between an unoperated position and an operated position, wherein a distance between the unoperated position and the particular face is greater than a distance between the operated position and the particular face.

8. The ink cartridge assembly of claim 7, wherein one of the first portion and the second portion comprises at least one slit formed therethrough, and the other of the first portion and the second portion comprises at least one pin configured to be positioned within the at least one slit.

9. The ink cartridge assembly of claim 8, wherein the at least one slit comprises a first slit portion and a second slit portion connected to a particular end of the first slit portion, and the second slit portion extends in a direction which is substantially perpendicular to the particular direction.

10. The ink cartridge assembly of claim 9, wherein the at least one pin is positioned within the second slit portion when the operation member is positioned in the unoperated position, and the at least one pin is positioned within the first slit portion when the operation member is positioned between the unoperated position and the operated position.

11. The ink cartridge assembly of claim 10, wherein the at least one slit further comprises a third slit portion connected to a further end of the first slit portion which is opposite from the particular end of the first slit portion, wherein the third slit portion extends in a direction which is substantially perpendicular to the particular direction, wherein at least one pin is positioned within the third slit portion when the operation member is positioned in the operated position.

12. The ink cartridge assembly of claim 11, wherein the first slit portion extends in a direction which is inclined with respect to the particular direction.

13. The ink cartridge assembly of claim 9, wherein the at least one pin is positioned within the second slit portion when the operation member is positioned in the operated position, and the at least one pin is positioned within the first slit portion when the operation member is positioned between the unoperated position and the operated position.

14. The ink cartridge assembly of claim 13, wherein the first slit portion extends in a direction which is inclined with respect to the particular direction.

* * * * *